US008011845B2

(12) United States Patent
Ho

(10) Patent No.: US 8,011,845 B2
(45) Date of Patent: Sep. 6, 2011

(54) MARKING INSTRUMENT

(76) Inventor: Edward Ho, Warren, NJ (US)

( * ) Notice: Subject to any disclaimer, the term of this patent is extended or adjusted under 35 U.S.C. 154(b) by 1274 days.

(21) Appl. No.: 11/580,746

(22) Filed: Oct. 12, 2006

(65) Prior Publication Data

US 2008/0108042 A1 May 8, 2008

(51) Int. Cl.
*B43K 5/04* (2006.01)

(52) U.S. Cl. ..... 401/170; 401/35; 401/87; 401/117

(58) Field of Classification Search ..... 401/19, 401/22, 35, 87, 88, 92–94, 170, 193, 117
See application file for complete search history.

(56) References Cited

U.S. PATENT DOCUMENTS

| | | | | |
|---|---|---|---|---|
| 3,179,089 | A | 4/1965 | Civitarese | |
| 3,708,235 | A * | 1/1973 | Kolomeir | 401/57 |
| 4,354,767 | A | 10/1982 | Tessier | |
| 5,052,838 | A | 10/1991 | Tucker | |
| 5,490,738 | A | 2/1996 | Pearce | |
| 6,454,479 | B1 | 9/2002 | Lychwick | |
| 6,702,495 | B1 | 3/2004 | Lychwick | |

* cited by examiner

*Primary Examiner* — David J Walczak
(74) *Attorney, Agent, or Firm* — Frommer Lawrence & Haug LLP

(57) ABSTRACT

A marking instrument including a body portion having an internal cavity disposed therein with a rotation means disposed within the interior cavity of the body portion. The marking instrument also includes a marking platform having at least one marking element disposed thereon and a cap element having an opening that corresponds to a geometric shape of a mark to be produced or the geometric shape of an answer space.

62 Claims, 30 Drawing Sheets

MARKING INSTRUMENT

FIELD OF THE INVENTION

The present invention relates to a marking instrument for use when filling in answer spaces on an answer sheet of, for example, a standardized test. More specifically, the present invention is directed to a mechanical-type pencil having a rotational portion that can be used to mark spaces of a standardized test answer having varying geometries such as, but not limited to, rectangular, circular and oval.

BACKGROUND

Standardized multiple choice answer sheets and systems which automatically grade those answer sheets are in widespread use in American education. These tests represent a quick, easy and inexpensive way to test large numbers of people for basic skills and specific skills taught in the classroom. Standardized tests such as the Scholastic Aptitude Test (SAT) and the ACT are widely used by universities to screen applicants. Similar standardized tests are also used to measure progress and assign grades in grammar school, high school, college and post-graduate courses.

The method of taking a standardized multiple choice test is simple. The examiner provides a standardized multiple choice test consisting of a list of sequentially numbered questions. Each question has a number of possible answers, usually labeled as answers "A," "B," "C," etc. or "true" and "false." The examiner also provides a standardized multiple choice answer sheet which is pre-marked with a matrix of answer spaces. Typically, each row of answer spaces in the matrix is assigned a number, marked on the left margin of the answer sheet, which corresponds to the number of the test question which is to be answered in that row. Each answer space in the row of answer spaces is typically assigned a letter, which corresponds to the answer choices available on the standardized test. To answer each question, the test-taker uses a pencil to mark or fill in the answer space which corresponds to the chosen answer for the question in the row of answer spaces which correspond to the question being answered. Completed sheets are typically scanned by an optical marking (OMR) apparatus that determines which answer blank has been marked or filled in for each question.

Although this is an efficient method of administering tests, there are disadvantages to using the standardized answer sheets. For example, when an answer space is not completely filled in or when a test taker over marks and answer space, the OMR apparatus can register an incorrect answer. Further, filling in each individual answer space with a conventional pencil can be time consuming, especially for exams that contain numerous questions.

Therefore, a need exists to provide a marking instrument or pencil that can quickly and accurately fill in or mark answer spaces on a standardized test answer sheet.

SUMMARY OF THE INVENTION

It is therefore a principal object of the present invention to provide a marking instrument that can allow a user to quickly fill in answer spaces having a variety of geometric shapes.

A further object of the present invention is to provide a marking instrument that accurately fills in answer spaces having a variety of geometric shapes.

Yet another object of the present invention is to provide a user with an instrument that saves the user time when filling in answer spaces for a multiple choice test.

A further object of the present invention is to provide a marking instrument that uses a rotational motion to produce a mark having a certain geometric shape on a sheet of paper.

These and other objects and advantages are provided by the instant invention. In this regard, the present invention is directed to a marking instrument that, in a first embodiment, comprises an upper and lower body portion having internal cavities disposed therein. Disposed within the internal cavity of the upper body portion is a depressor element that is seated on a depressor spring. The depressor element includes an internal cavity having a plurality of angled fins or protrusions that receive a spirally-grooved circular shaft that is inserted into the depressor element from its bottom end. In addition, a means is provided in order to prevent the depressor element from rotating within the upper body portion's internal cavity. In order to keep the internal elements within the upper body portion and to provide a user with a means for depressing the depressor element, a push cap is placed on top of the depressor element and the upper body portion.

Inserted into the bottom end of the cavity formed in the lower body portion is an elongated portion of a marking platform. The elongate portion of the marking platform engages a keyed or recessed portion in the bottom of the spirally-grooved circular shaft such that the circular shaft and the marking platform rotate as a single structure. Attached to the bottom of the marking platform is at least one marking element that can be, for example, graphite or ink. Typically, a plurality of marking elements will be attached to the bottom of the marking platform. Additionally, attached to the bottom end of the lower body portion is a cap element that includes an opening in its bottom end. In order to produce marks having different geometric shapes, thereby allowing a user to fill in answer spaces that are, for example, circular, oval and rectangular, the opening in the cap element can have geometric shapes that correspond to the geometric shape of the desired mark to be produced, i.e. the geometric shape that corresponds to the geometry of an answer space.

To fill in an answer space or produce a mark on a sheet of paper using a marking instrument according to the first embodiment, a user simply positions the marking instrument over the desired answer space and depresses the push cap which in turn depresses the depressor element. The downward motion of the depressor element imparts a rotational motion to the spirally-grooved circular shaft, which in turn rotates the marking platform. As the marking platform rotates, a mark is produced on the sheet of paper by the marking element(s). In order to help a user more easily and more accurately position the marking instrument over a desired answer space, the marking instrument may also include a light emitting diode ("LED") and/or an optical waveguide.

In a second embodiment, a marking instrument according to the present invention comprises a body portion having an internal cavity disposed therein. Disposed within the internal cavity of the body portion is a rotation means. The rotation means can be, for example, an electric motor or the depressor element/spirally-grooved circular shaft combination described above for the first embodiment. The rotation means includes a structure having a keyed or recessed portion. In addition, the instant embodiment comprises a marking platform having an elongate portion. The marking platform includes at least one marking element attached to the bottom of the marking platform that can be, for example, graphite or ink. Typically, a plurality of marking elements will be attached to the bottom of the marking platform. To join the rotation means to the marking platform, the elongate portion of the marking platform engages the keyed or recessed portion of the rotation means such that the rotation means and the marking platform rotate as a single structure.

Additionally, attached to the bottom end of the body portion is a cap element that includes an opening in its bottom end. In order to produce marks having different geometric shapes, thereby allowing a user to fill in answer spaces that are, for example, circular, oval and rectangular, the opening in the cap element can have geometric shapes that correspond to the geometric shape of the desired mark to be produced, i.e. the geometric shape that corresponds to the geometry of an answer space.

To fill in an answer space or produce a mark on a sheet of paper using a marking instrument according to the second embodiment, a user simply positions the marking instrument over the desired answer space and activates the rotation means. The rotating rotation means in turn rotates the marking platform. As the marking platform rotates, a mark is produced on the sheet of paper by the marking element(s). In order to help a user more easily and more accurately position the marking instrument over a desired answer space, the marking instrument may also include a light emitting diode ("LED") and/or an optical waveguide.

In a third embodiment, a marking instrument according to the present invention comprises a body portion having an internal cavity disposed therein. Disposed within the internal cavity of the body portion is an electric motor and at least one battery. Located on the exterior of the body portion is a switch that activates the electric motor. Attached to the drive shaft of the electric motor is a drum that includes a bottom portion having a keyed or recessed portion.

Additionally, the marking instrument of the instant embodiment further comprises a marking platform having an elongate portion. The marking platform includes at least one marking element attached to the bottom of the marking platform that can be, for example, graphite or ink. Typically, a plurality of marking elements will be attached to the bottom of the marking platform. To join the drum to the marking platform, the elongate portion of the marking platform engages the keyed or recessed portion of the drum such that the marking platform rotates when the drive shaft of the electric motor rotates.

In addition, attached to the bottom end of the body portion is a cap element that includes an opening in its bottom end. In order to produce marks having different geometric shapes, thereby allowing a user to fill in answer spaces that are, for example, circular, oval and rectangular, the opening in the cap element can have geometric shapes that correspond to the geometric shape of the desired mark to be produced, i.e. the geometric shape that corresponds to the geometry of an answer space.

To fill in an answer space or produce a mark on a sheet of paper using a marking instrument according to the third embodiment, a user simply positions the marking instrument over the desired answer space and activates the motor using the switch. The activated motor in turn rotates the marking platform. As the marking platform rotates, a mark is produced on the sheet of paper by the marking element(s). In order to help a user more easily and more accurately position the marking instrument over a desired answer space, the marking instrument may also include a light emitting diode ("LED") and/or an optical waveguide.

In this text, the terms "comprising", "comprise", "comprises" and other forms of "comprise" can have the meaning ascribed to these terms in U.S. Patent Law and can mean "including", "include", "includes" and other forms of "include".

The various features of novelty which characterize the invention are pointed out in particularity in the claims annexed to and forming a part of this disclosure. For a better understanding of the invention, its operating advantages and specific objects attained by its uses, reference is made to the accompanying drawings and description in which various embodiments of the invention are illustrated and disclosed in accordance with the present invention.

BRIEF DESCRIPTION OF THE DRAWINGS

The following detailed description, given by way of example and not intended to limit the present invention, will be best appreciated in conjunction with the accompanying drawings, wherein like reference numerals denote like elements and parts, in which.

DETAILED DESCRIPTION OF THE PREFERRED EMBODIMENTS

Figure 1:
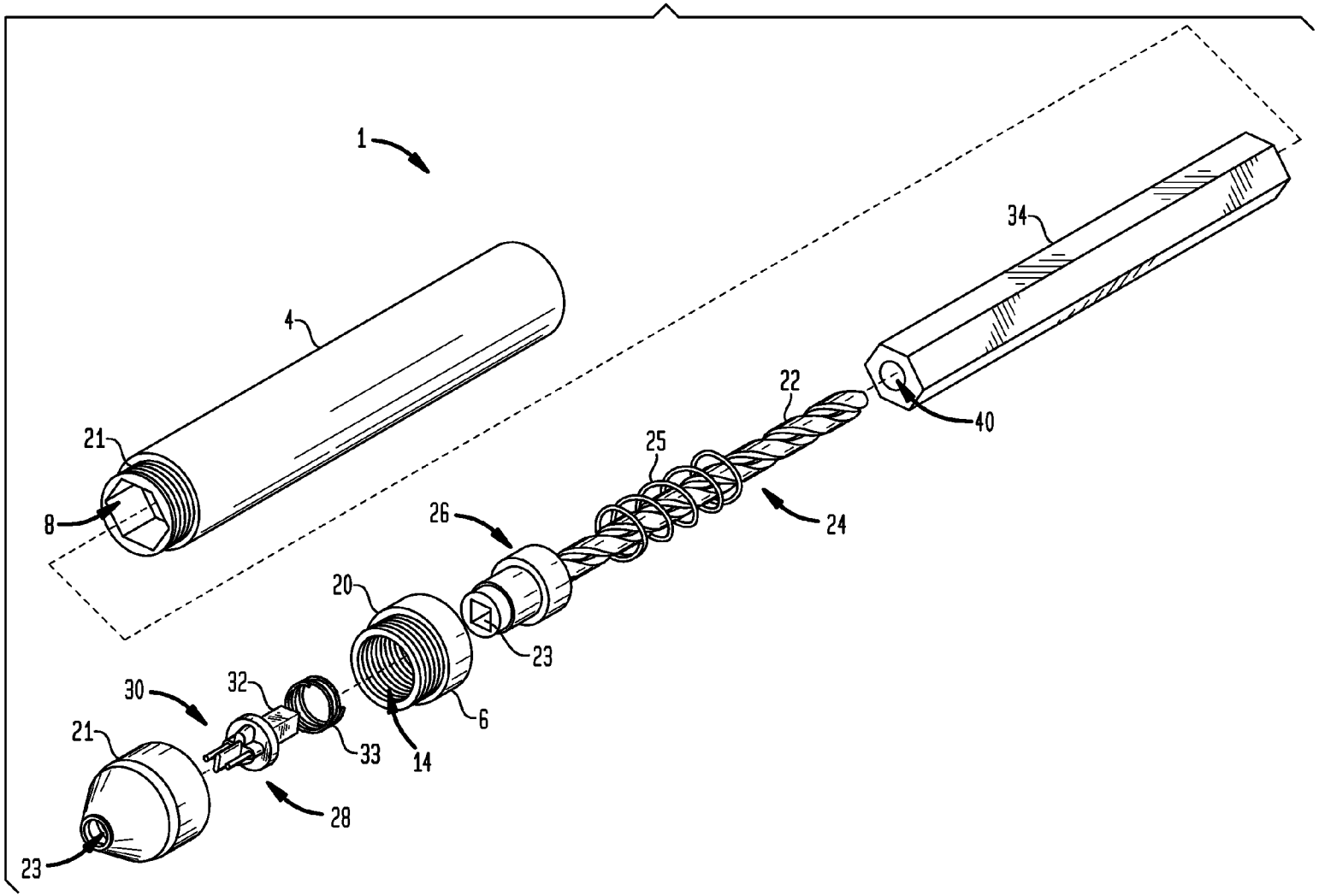
FIG. 1 is an exploded perspective view of a marking instrument, according to one embodiment of the present invention.

The instant invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

The instant invention relates to a marking instrument or mechanical-type pencil that can be used to mark or fill in answer spaces on a multiple choice test answer sheet. The instant invention can easily be used to fill in answer spaces having different geometries, such as, but not limited to, circular, oval and rectangular spaces. To fill in an answer space, a user or test taker need only position the bottom portion of the marking instrument over the desired answer space. Once positioned, the user rotates the bottom portion of the marking instrument that is in contact with the answer sheet, either mechanically by depressing a portion of the instrument or by actuating an electric motor. Rotating the bottom portion of the marking instrument results in the marking or filling in of the desired answer space.

In the following description, like reference characters designate like or corresponding parts throughout the figures. Additionally, in the following description, it is understood that such terms as "upper," "top," lower," bottom," and the like, are words of convenience and are not to be construed as limiting terms.

Figure 2:
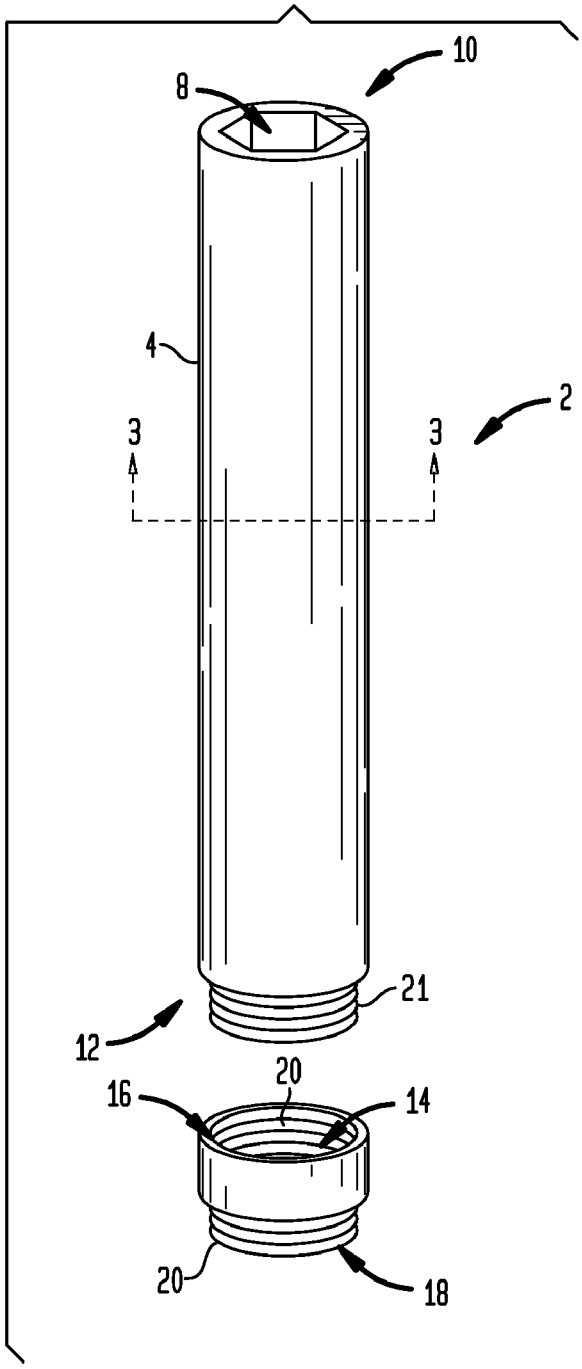
FIG. 2 is an exploded perspective view of a body portion, according to one embodiment of the present invention.
Figure 3:
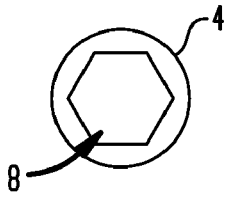
FIG. 3 is a cross-sectional view of the body portion depicted in FIG. 2.

Turning now to the figures, in a first embodiment of the instant invention depicted in FIGS. 1 and 2, the marking instrument 1 comprises a main body portion 2 that includes an upper body portion 4 and a lower body portion 6. As can be seen in FIGS. 1, 2 and 3 where FIG. 3 is a cross-sectional view of FIG. 2, the upper body portion 4 has a hexagonal internal cavity 8 that extends along the entire length of the upper body portion 4, from the top end 10 to the bottom end 12. As will be described below, the cross-sectional shape of the internal cavity 8 can be of numerous geometries. The lower body portion 6 also includes a hollow internal cavity 14 that extends from the top end 16 to the bottom end 18 of the lower body portion 6. The cross-sectional shape of the internal cavity 14 of the lower body portion 6 is circular. Additionally, the lower body portion 6 includes threads 20 at both its top 16 and bottom 18 ends. To assemble the upper body portion 4 and the lower body portion 6, the top end threads 20 of the lower body portion are screwed into corresponding threads 21 on the exterior of the bottom end 12 of the upper body portion 4. Instead of being screwed together, the bottom end 12 of the upper body portion 4 and the top end 16 of the lower body portion 4 can be constructed such that they snap together. As will be apparent to those skilled in the art, any means that allows the upper body portion 4 and the lower body portion 6 to be joined together may be used.

Figure 4A:
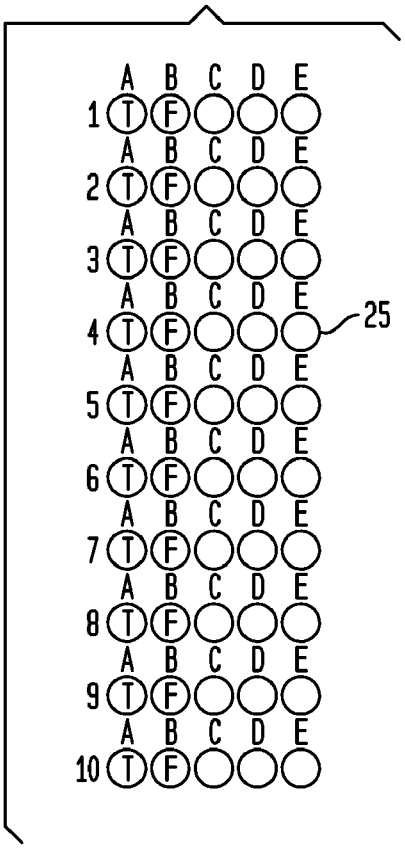
FIG. 4A is a sample of a multiple choice answer sheet having circular-shaped answer spaces.
Figure 4B:
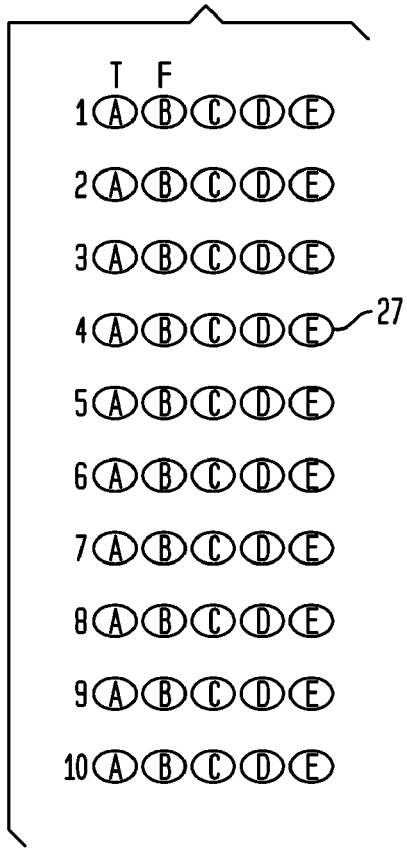
FIG. 4B is a sample of a multiple choice answer sheet having oval-shaped answer spaces.
Figure 4C:
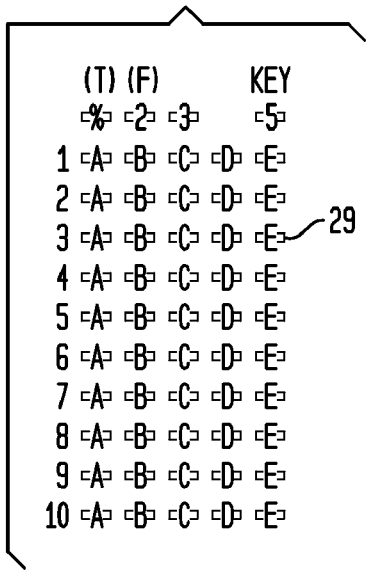
FIG. 4C is a sample of a multiple choice answer sheet having rectangular-shaped answer spaces.

Attached to the bottom end 18 of the lower body portion 6 is a cap element 21. The cap element 21 screws onto the threads 20 at the bottom end 18 of the lower body portion 6. As depicted in FIG. 1, the cap element 21 includes an opening 23 having a shape that corresponds to the geometric shape of the answer spaces on an answer sheet. As shown in FIGS. 4A, 4B and 4C, answer spaces typically have a circular 25, oval 27 or rectangular 29 shape. Consequently, the opening 23 in the cap element 21 can have various geometric shapes, such as but not limited to, circular, oval and rectangular, that correspond to the geometry of the answer spaces on an answer sheet. Therefore, changing the cap element 21 allows a person to take a multitude of tests having answer spaces of different geometric configurations.

Figure 5A:
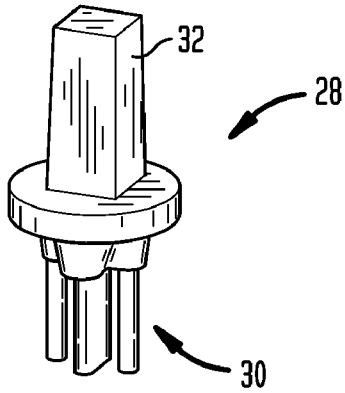
FIG. 5A is a top perspective view of a marking platform, according to one embodiment of the present invention.
Figure 5B:
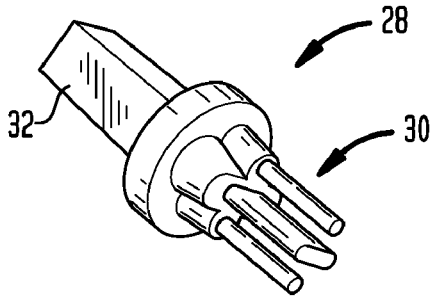
FIG. 5B is a bottom perspective view of the marking platform depicted in FIG. 5A

Disposed between the lower body portion 6 and the cap element 21 is a marking platform 28 that, as depicted in FIGS. 5A and 5B, includes at least one marking element 30. Typically, a plurality of marking elements 30 are included on the marking platform 28. The marking elements 30 may be graphite lead, ink or any other element that is capable of producing a mark on a sheet of paper. The marking elements 30 may all have the same shape or marking elements having different shapes may be used as will be described in more detail below. If graphite leads are used, the leads may all have the same hardness or they may have different hardnesses. The marking elements 30 can be changed as necessary based on varying wear rates or the geometry or shape of the mark to be transferred to the paper.

As depicted in FIGS. 5A and 5B, the top of the marking platform 28 includes an elongate portion 32 for the reason described below. The elongate portion 32 is long enough such that when it is inserted into the internal cavity 14 at bottom end 18 of the lower body portion 6, it protrudes through the top end 16 of the lower body portion 6. The marking platform 28 is a multipiece construction so that the individual pieces can move up and down independently of one another. The reason for the marking platform 28 being constructed in this manner will be described in detail below. The marking elements 30 are positioned on the bottom of the marking platform 28 such that when the platform 28 rotates, a completely filled in geometric shape will be drawn on a paper surface with which the leads contact. That is, there will be no unfilled areas within the boundaries of the geometric shape. Located between the bottom end 18 of the lower body portion 6 and the top of the marking platform 28 is a spring 33 that is disposed on the elongate portion 32 of the marking platform 28.

The marking instrument further comprises a circular shaft 22 that has a spirally-grooved exterior surface 24. The bottom end 26 of the circular shaft 22 has a keyed portion 23 in order to receive the elongate portion 32 of the marking platform 28. The diameter of the circular shaft 22 is greater than the diameter of the internal cavity 14 in the lower body portion 6 so that the circular shaft 22 is restricted from passing entirely through the internal cavity 14 when it rotates. Additionally, the elongate portion 32 at the top of the marking platform 28 and the keyed portion 23 at the bottom end 26 of the circular shaft 22 have complementary shapes that allow the keyed portion 23 of the circular shaft 22 and the elongate portion 32 of the marking platform 28 to mate or interlock together such that when the circular shaft 22 rotates, the marking platform 28 rotates as well. Disposed on the circular shaft 22 is a first spring or a depressor spring 25.

Figure 6:
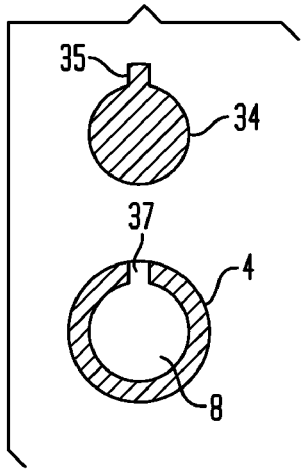
FIG. 6 is a cross-sectional view of a rotation prevention means, according to one embodiment of the present invention.
Figure 7:
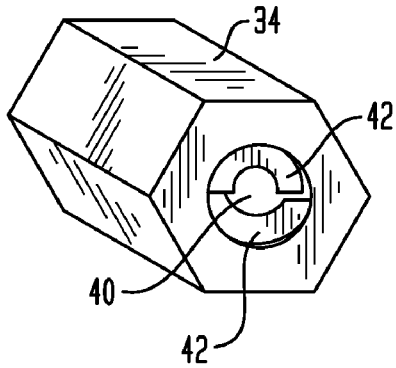
FIG. 7 is a perspective view of a depressor element, according to one embodiment of the present invention.
Figure 8A:
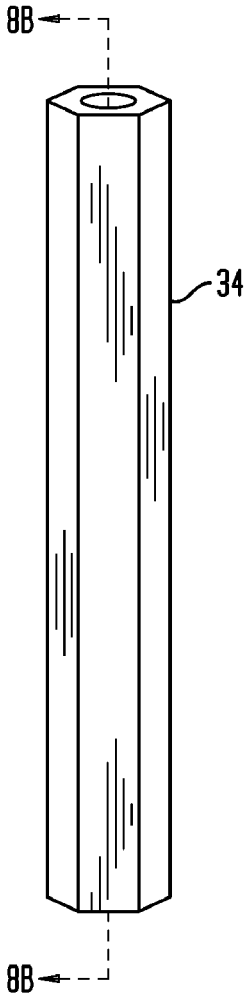
FIG. 8A is a perspective view of a depressor element, according to one embodiment of the present invention.
Figure 8B:
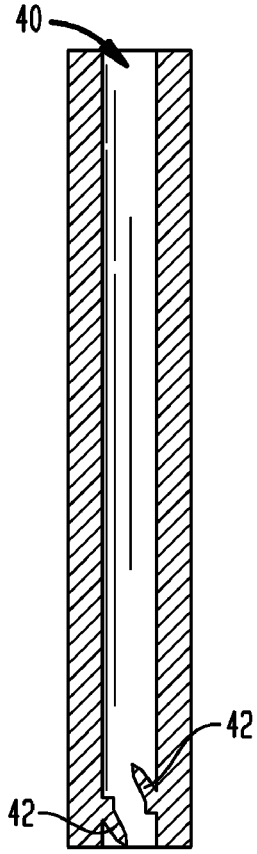
FIG. 8B is a cross-sectional view of the depressor element depicted in FIG. 8A.

As depicted in the figures, the marking instrument 1 further comprises a depressor element 34 that has an exterior cross-sectional shape that is complementary to the cross-sectional shape of the internal cavity 8 of the upper body portion 4. In the instant embodiment, the depressor element 34 has a hexagonal cross-sectional shape that corresponds to the hexagonal shape of the internal cavity 8 of the upper body portion 4. The complementary shapes of the interior cavity 8 and the exterior of the depressor element 34, prevent the depressor element 34 from rotating with respect to the upper body portion 4. Consequently, the complementary shapes of the internal cavity 8 and the exterior of the depressor element 34 can be any geometry, such as, but not limited to triangular, rectangular, square, oval, etc., that prevents the depressor element 34 from rotating within the upper body portion 4. In addition to having complementary shapes, the depressor element 34 and the internal cavity 8 can be constructed in any manner that prevents the depressor element 34 from rotating within the internal cavity 8. An example of an additional rotation restriction means may be, as depicted in FIG. 6 which shows cross-sectional views of a depressor element 34 and an upper body portion 4, one that includes one or more longitudinally extending ribs 35 on the exterior wall of the depressor element 34 that engage(s) one or more narrow, elongate, grooves 37 on the interior wall surface of the internal cavity 8. With this type of construction the cross-sectional shape of the depressor element 34 and the internal cavity 8 may be circular except for the rib(s) and grooves(s). Additionally, extending on the interior of the depressor element 34 from the top end 36 to the bottom end 38 is a circular internal cavity 40. As shown in FIG. 7, the internal cavity 40 includes a plurality of angled fins or complementary protrusions 42 to receive the external grooves 24 of the circular shaft 22. FIG. 8A is a perspective view of a depressor element 34 according to the instant embodiment and FIG. 8B is a cross-sectional view of the depressor element 34 depicted in FIG. 8A.

Assembly of a marking device according to the first embodiment of the instant invention will now be described in detail. The order of assembly steps is only one example of one way that a marking instrument according to the first embodiment may be assembled. As will be apparent to those skilled in the art, the assembly steps may be performed in any order that results in a marking device that operates as described below. To assemble the main body portion 2, the top end 16 of the lower body portion 6 is screwed into the bottom end 12 of the upper body portion 6. The lower body portion 6 screws into the upper body portion 4 in a direction opposite to that of the direction of rotation of the circular shaft 22. As previously disclosed, the upper body portion 4 and the lower body portion 6 may also be constructed such that they snap together.

Figure 9A:
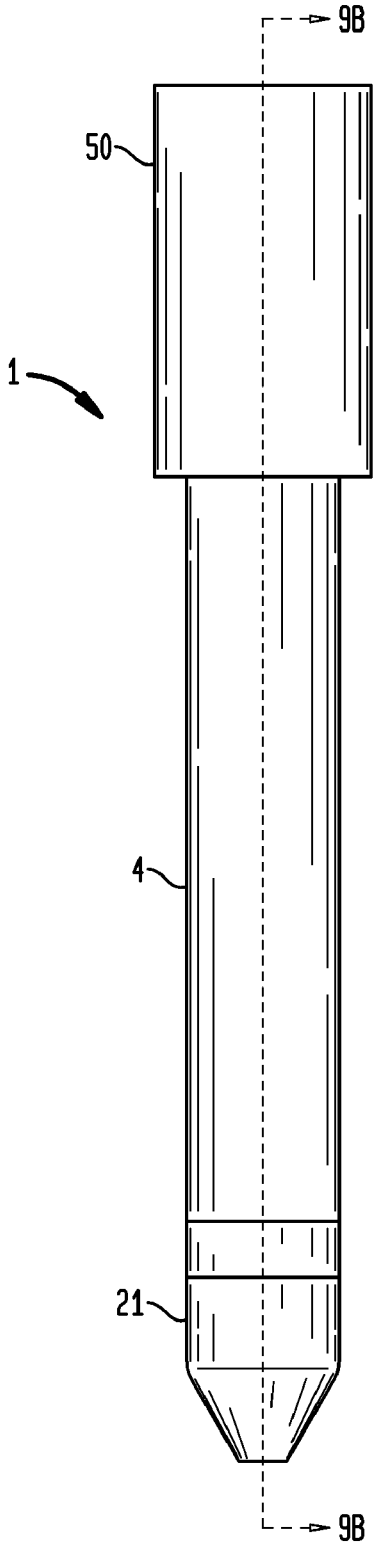
FIG. 9A is a side view of a marking instrument, according to one embodiment of the present invention.
Figure 9B:
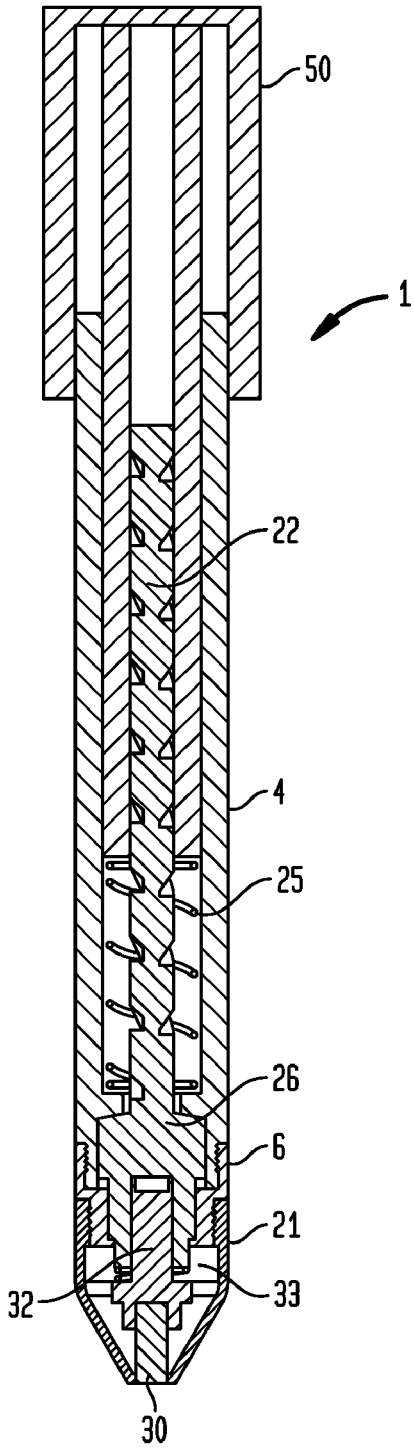
FIG. 9B is a cross-sectional view of the marking instrument depicted in FIG. 9A.

Next, a spring (depressor spring) 25 is inserted into the internal cavity 8 of the upper body portion 4. The depressor element 34 is then inserted into the internal cavity 8 of the upper body portion 4 on top of the spring 25. The spring 25 causes the depressor element 34 to protrude above the top end 10 of the upper body portion 4. Inserted (e.g. prior to inserting depresser element 34 into internal cavity 8) into the bottom end of the internal cavity 40 of the depressor element 34 is circular shaft 22. The circular shaft 22 is inserted using a rotational motion so that the angled fins or protrusions 42 on the interior of the internal cavity 40 engage the external grooves 24 of the circular shaft 22. As depicted in FIG. 9B, which is a cross-sectional view of FIG. 9A that shows a marking instrument 1 constructed according to the instant embodiment, a push cap 50 is placed onto the top end 10 of the upper body portion 4 in order to keep the internal elements of the marking instrument 1 contained within the interior of the main body 2 and to provide a user with a means to depress the depressor element 34. Because the depressor element 34 protrudes above the top end 10 of the upper body portion 4, the push cap 50 must be installed such that it can move or slide up and down when a user depresses the cap portion 50 to depress the depressor element 34 in order to rotate the marking platform 28. With the main body 2 of the marking instrument assembled, the lower portion of the instrument can be assembled.

The lower portion of the marking instrument is assembled by disposing a second spring 33 on the elongate portion 32 of the marking platform 28. The second spring 33 urges the marking platform 28 and the marking elements 30 toward the paper sheet allowing for the precise adjustment of the downward force onto the object to be marked. The elongate portion 32 of the marking platform 28 is then inserted into the bottom end 18 of the lower body portion 6, into the circular cavity 14. The marking platform 28 is rotated so that the keyed portion of the circular shaft 22 and the elongate portion 32 of the marking platform 28 engage and mate with one another. Lastly, the desired cap element 21 is screwed onto the threads 20 at the bottom end 18 of the lower body portion 6, thereby completing assembly of the marking instrument.

To operate a marking instrument according to the first embodiment of the instant invention, a user positions the assembled instrument having a cap element 21 attached with an opening 23 that corresponds to the geometric shape of the answer spaces on an answer sheet, over the desired answer space. Once the cap element 21 is in contact with the answer sheet, a user depresses the push cap 50. Depressing the push cap 50 causes the depressor element 34 to be depressed vertically downward. The vertical downward movement of the depressor element 34 imparts a rotational motion to the circular shaft 22. That is, the angled fins or protrusions 42 in the depressor element's internal cavity 40, travel within the spirally-grooved surface 24 of the circular shaft 22, thereby rotating the shaft 22 as the depressor element 34 moves up and down. The rotating circular shaft 22 rotates the marking platform 28 by way of the interlocked or mated keyed portion of the circular shaft 22 and the elongate portion 32 of the marking platform 28.

In one embodiment, the cap element 21 is designed so that the marking elements 30 rotate between the opening in the bottom of the cap element 21 and the bottom edges of the cap element 21 as will be described below in more detail.

Therefore, in this embodiment, the rotating marking elements 30 on the bottom of the marking platform 28 rotate on a portion of the interior of the cap element 21 and contact the answer sheet through the opening 23. As will be apparent to those skilled in the art, as the marking platform 28 rotates, some of the marking elements 30 will be contacting the inside of the cap element 21 and the answer sheet in an alternating fashion. Therefore, to compensate for the varying thickness between the cap 21 material and the opening 23 in the cap element 21 and to compensate for the different wear rates of the marking elements 30, such as graphite, due to their position on the marking platform 28, the spring 33 is used in conjunction with the multiple piece construction of the marking platform 28 to permit portions of the marking platform 28 to move up and down independently of one another, for example, through the use of a living hinge, as the marking platform 28 rotates. Furthermore, the cap element 21 may also be designed in such a fashion so as to steer the outer marking elements, not just up and down but left, right, back and forth in order to draw different shapes. This will be discussed in more detail below.

Once the push cap 50 and the depressor element 34 are completely depressed, the depressor spring 25 urges both elements vertically upwards to their starting positions. One depression of the push cap 50 and the depressor element 34 should completely fill in and darken an answer space, however, a user may repeat this process as many times as necessary to obtain the desired marking.

Figure 12A:
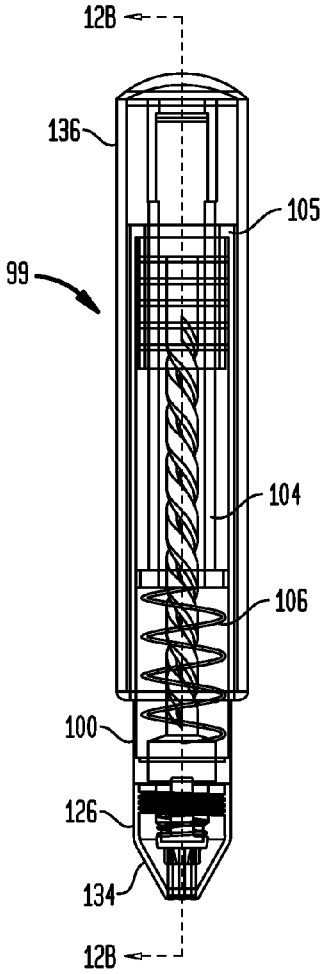
FIG. 12A is a cut away view of a marking instrument, according to one embodiment of the present invention.
Figure 12B:
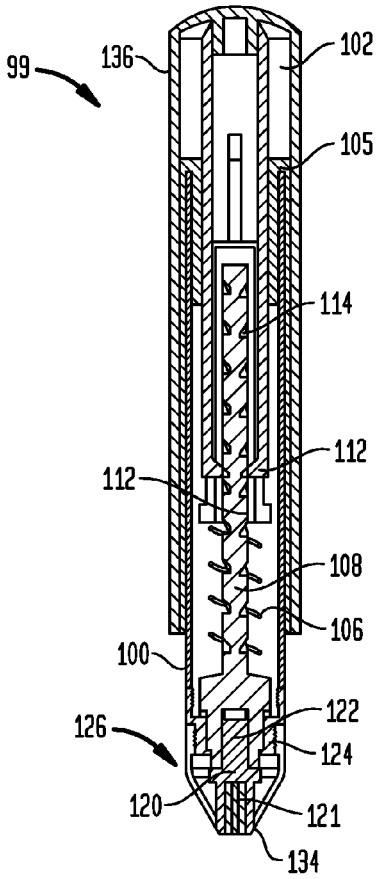
FIG. 12B is a cross-sectional view of the marking instrument depicted in FIG. 12A.
Figure 14:
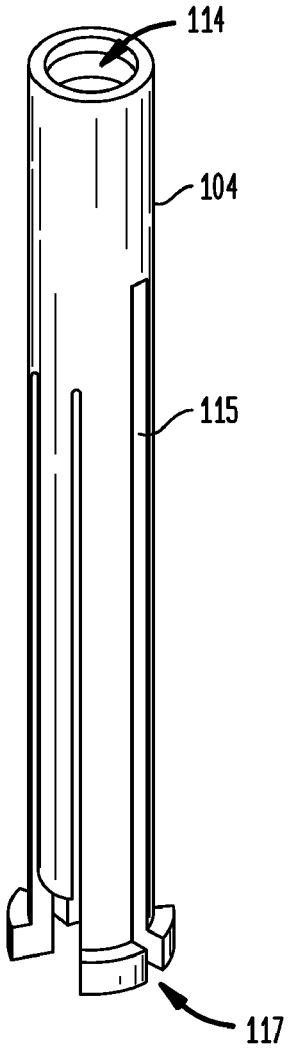
FIG. 14 is a perspective view of a depressor element, according to one embodiment of the present invention.
Figure 15A:
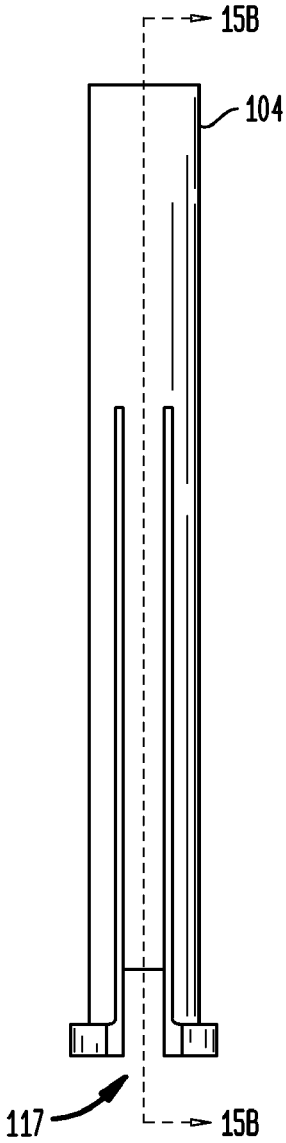
FIG. 15A is a side view of a depressor element, according to one embodiment of the present invention.
Figure 15B:
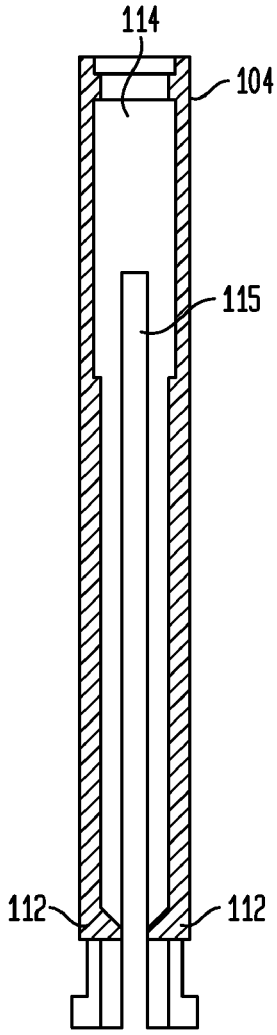
FIG. 15B is a cross-sectional view of the depressor element depicted in FIG. 15A.
Figure 16A:
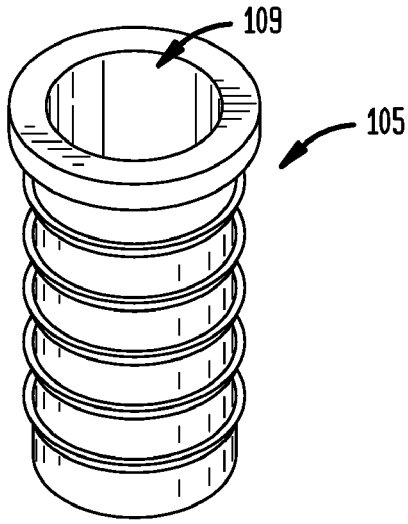
FIG. 16A is a perspective view of a rotation restricting element, according to one embodiment of the present invention.
Figure 16B:
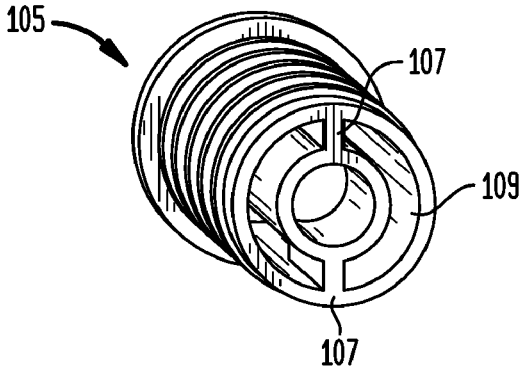
FIG. 16B is a bottom perspective view of the rotation restricting element depicted in FIG. 16A.

A second embodiment of the instant invention will now be discussed. As depicted in FIGS. 10, 11, 12A and 12B, a marking instrument 99 according to this embodiment comprises a circular body portion 100 having a hollow internal cavity 102. FIG. 12B is a cross-sectional view of a marking instrument constructed according to the instant embodiment, taken of FIG. 12A. Disposed within internal cavity 102 is a depressor element 104 that sits on a first spring or depressor spring 106. As depicted in FIGS. 14, 15A and 15B, where FIG. 15B is a cross-sectional view of FIG. 15A, the depressor element 104 includes an internal cavity 114. The internal cavity 114 can be any shape, but preferably, it is circular. The depressor element 104 also includes a plurality of elongate slots 115 that extend from a bottom end 117 of the depressor element 104 part way up the side of the depressor element 104. Further, disposed on the depressor element 104 is rotation restricting element 105. As depicted in FIGS. 16A and 16B, the rotation restricting element 105 is a tubular construction that has a plurality of wings 107 that extend within the internal cavity 109 of the rotation restricting element 105.

Figure 10:
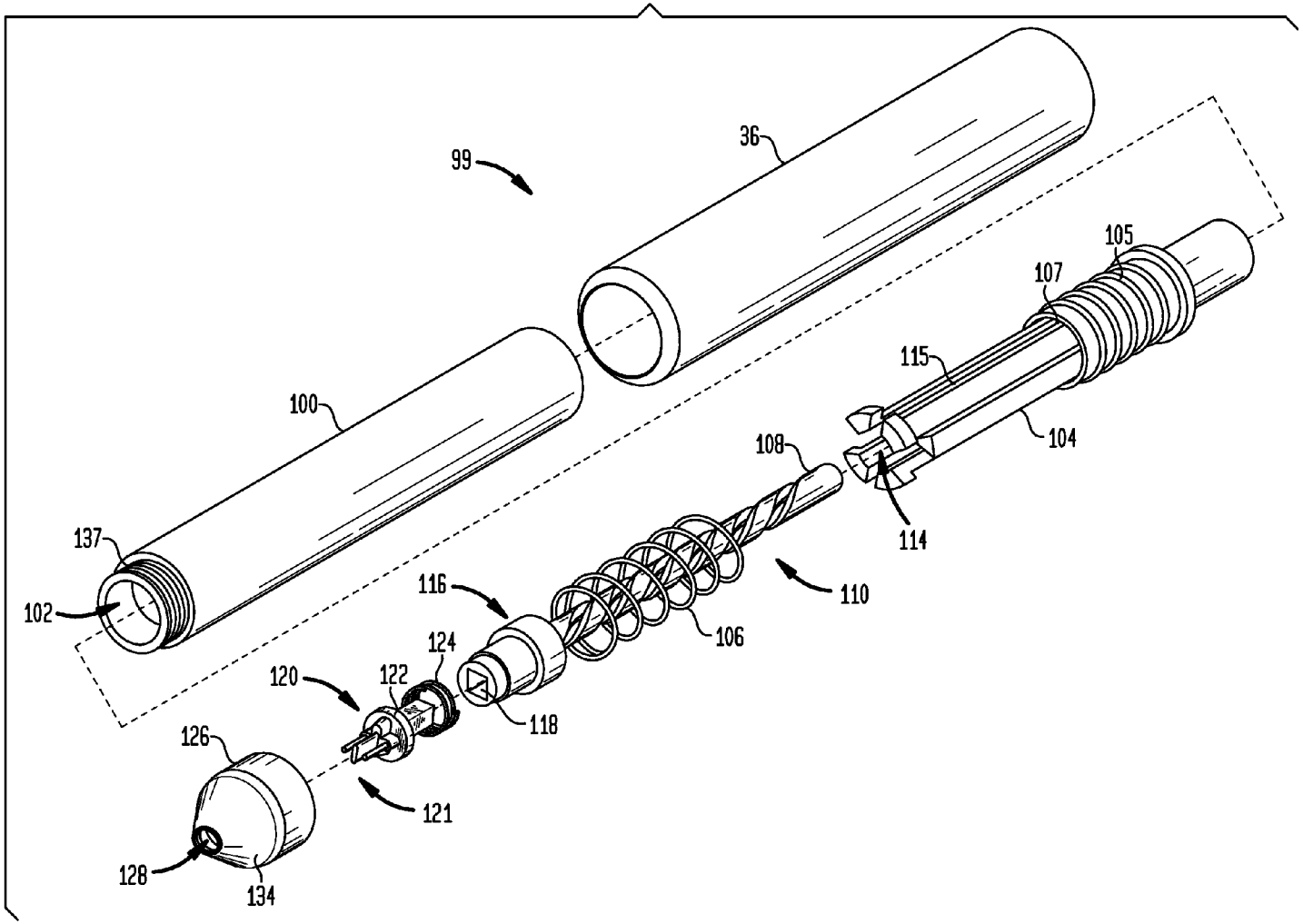
FIG. 10 is an exploded perspective view of a marking instrument, according to one embodiment of the present invention.
Figure 11:
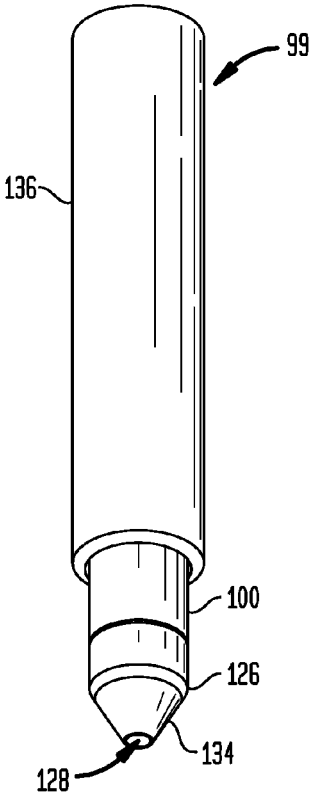
FIG. 11 is a perspective view of a marking instrument, according to one embodiment of the present invention.

As can be seen in FIG. 10, the rotation restricting element 105 is disposed onto the depressor element 104 such that the top ends of the elongate slots 115 do not engage the wings 107 at least until the depressor element 104 is fully depressed thereby fully compressing the depressor spring 106. This allows the depressor element 104 to freely slide up and down within the internal cavity 102 of the body portion 100 by way of the plurality of elongate slots 115 and wings 107. As can further be seen in FIG. 10, the rotation restricting element 105 is placed onto the depressor element 104 from its bottom end 117 such that the wings 107 are inserted into the elongate slots 115.

Figure 13A:
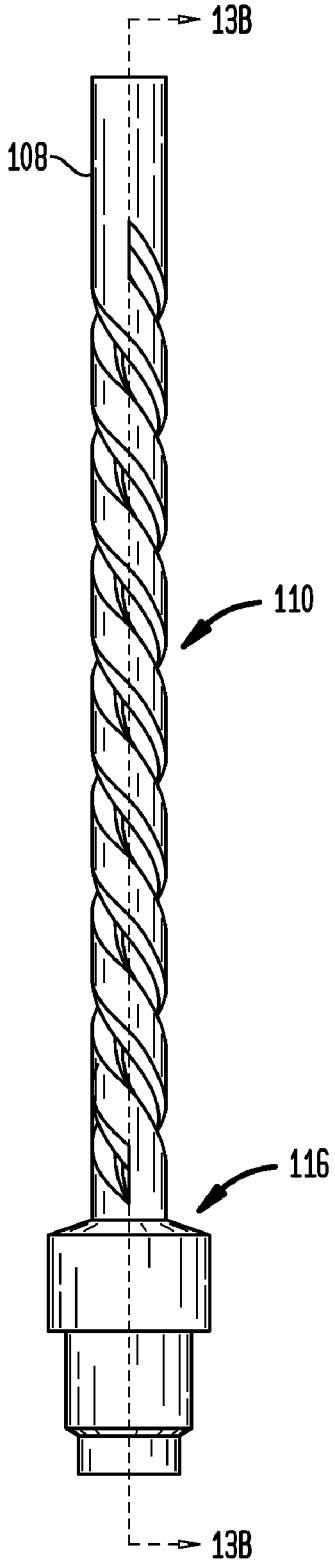
FIG. 13A is a side view of a spirally-grooved circular shaft, according to one embodiment of the present invention.
Figure 13B:
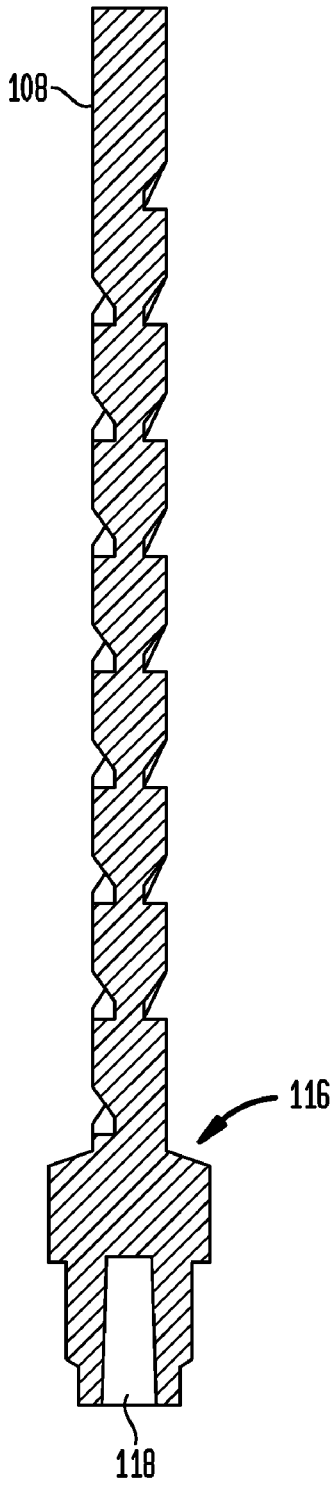
FIG. 13B is a cross-sectional view of the spirally-grooved circular shaft depicted in FIG. 13A.
Figure 17:
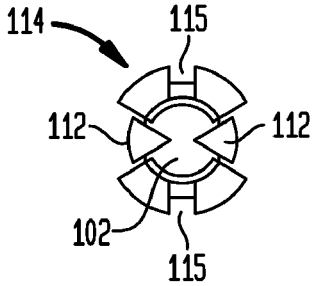
FIG. 17 is a bottom view of the depressor element, according to one embodiment of the present invention.

Also disposed within the internal cavity 102 is a circular shaft 108. As can be seen in the figures, specifically FIGS. 13A and 13B, where FIG. 13B is a cross-sectional view of the circular shaft 108 depicted in FIG. 13A, the circular shaft 108 has a spirally-grooved exterior surface 110. The spirally-grooved exterior surface 110 of the circular shaft 108 is designed to engage angled fins or protrusions 112 in the interior cavity 114 of the depressor element 104. FIG. 17, which is a bottom view of the depressor element 104 shows the angled fins or protrusions 112 that extend into the internal cavity 102 of the depressor element. The bottom portion 116 of the circular shaft 108 includes a keyed portion 118. As can be seen in FIG. 10, the keyed portion 118 in the instant embodiment is a square recess.

Figure 18A:
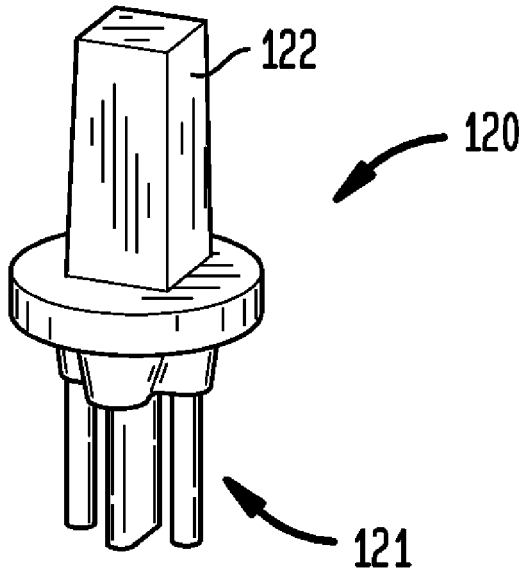
FIG. 18A is a top perspective view of a marking platform, according to one embodiment of the present invention.
Figure 18B:
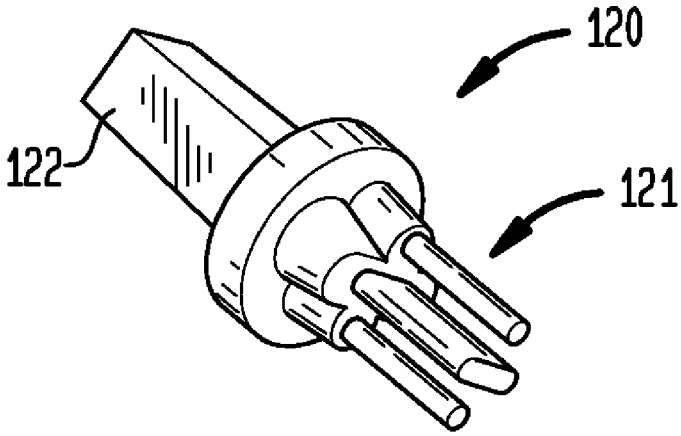
FIG. 18B is a bottom perspective view of the marking platform depicted in FIG. 18A
Figure 19A:
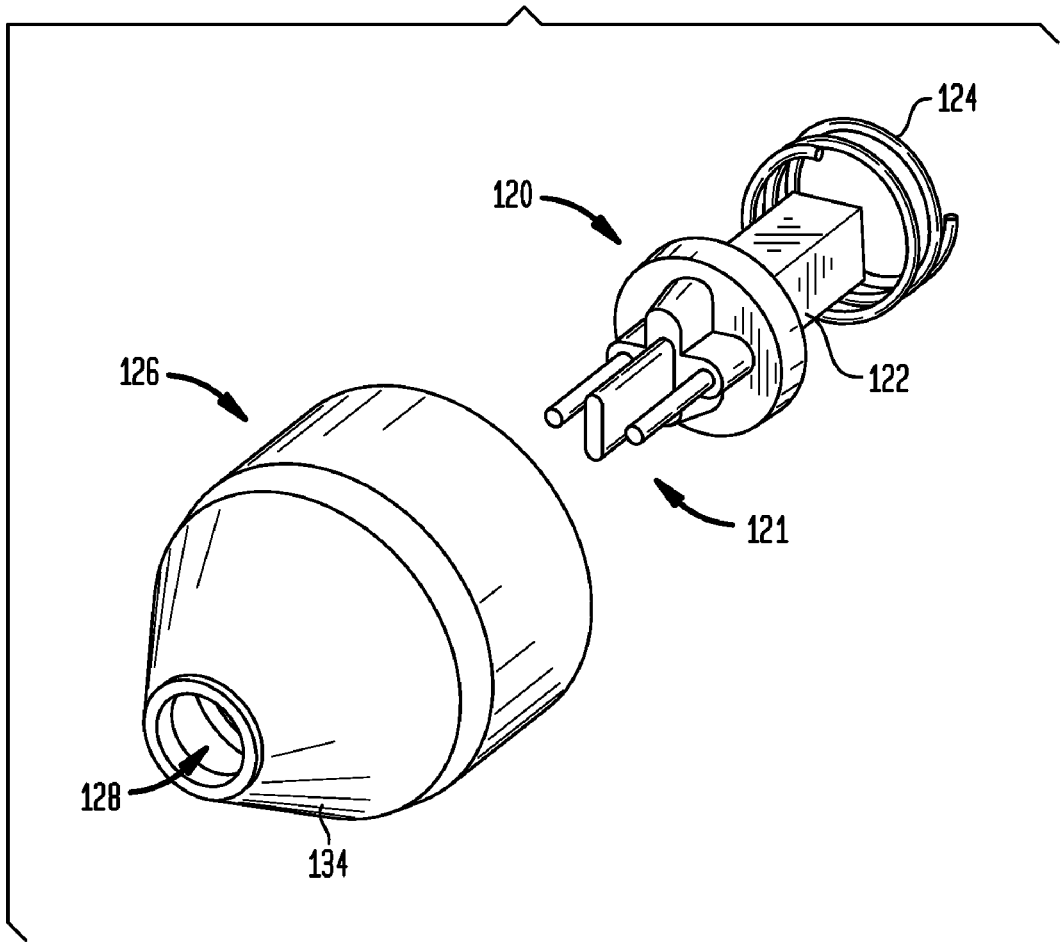
FIG. 19A is an exploded perspective view of a cap element with a marking platform, according to one embodiment of the present invention.
Figure 19B:
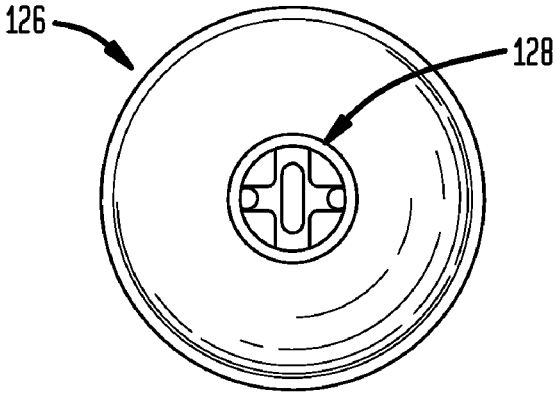
FIG. 19B is a bottom plan view of the cap element and marking platform depicted in FIG. 19A.
Figure 20A:
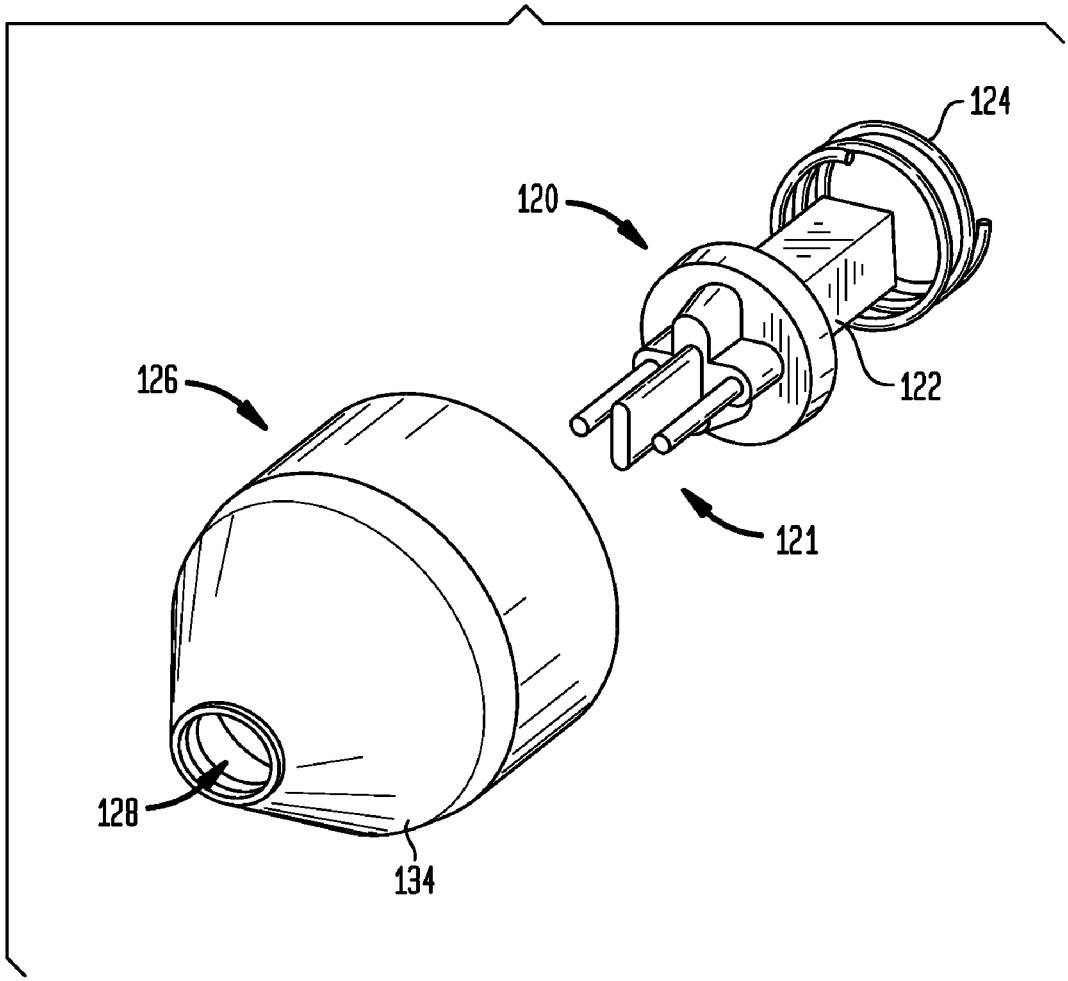
FIG. 20A is an exploded perspective view of a cap element with a marking platform, according to one embodiment of the present invention.
Figure 20B:
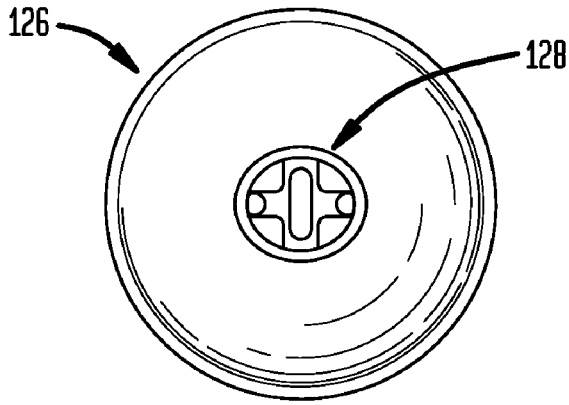
FIG. 20B is a bottom plan view of the cap element and marking platform depicted in FIG. 20A.
Figure 21A:
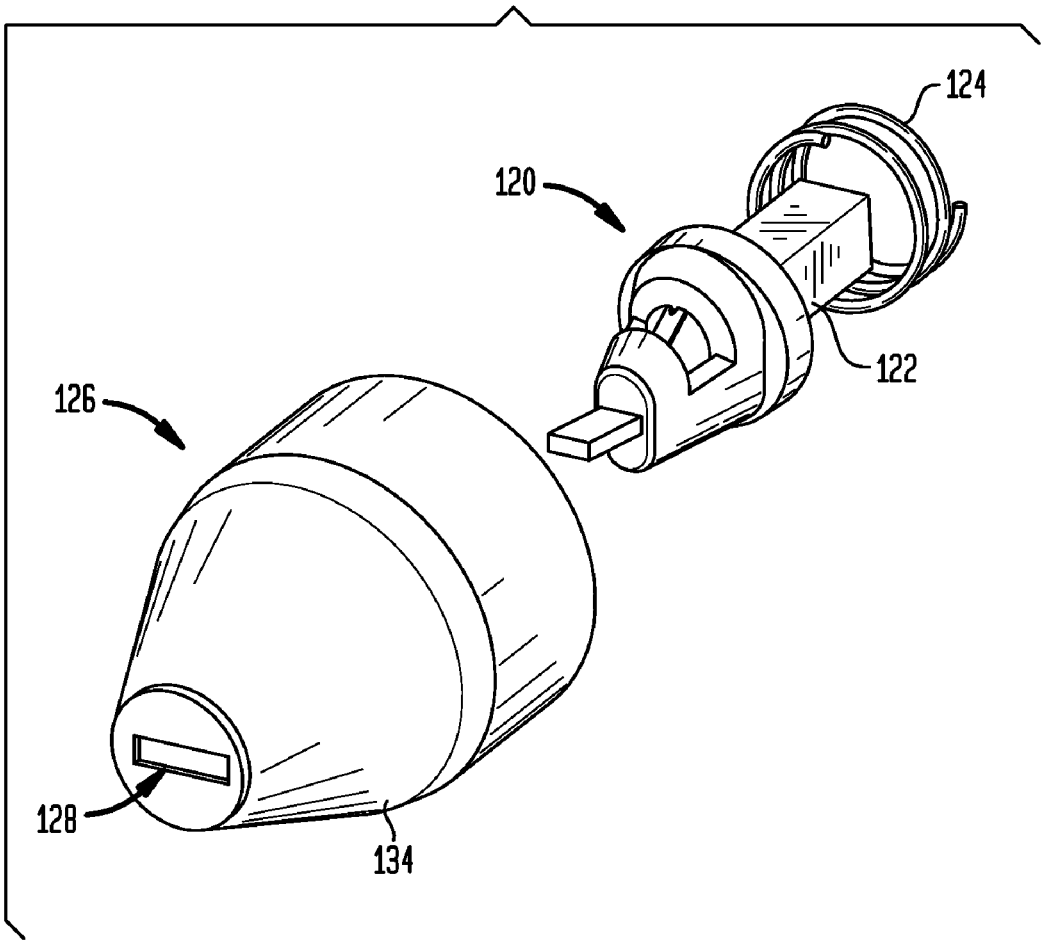
FIG. 21A is an exploded perspective view of a cap element with a marking platform, according to one embodiment of the present invention.
Figure 21B:
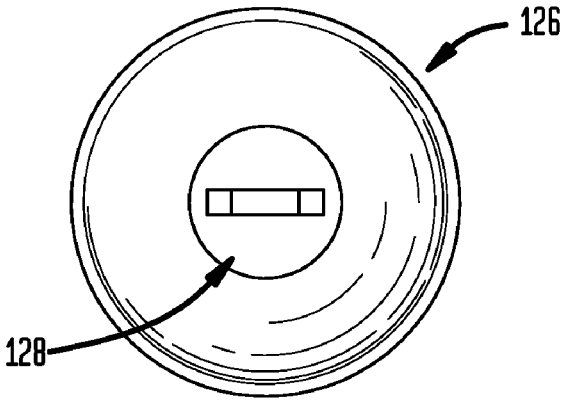
FIG. 21B is a bottom plan view of the cap element and marking platform depicted in FIG. 21A.

As depicted in FIG. 10, the marking instrument further comprises a marking platform 120 onto which at least one marking element 121 is attached. As can be seen in FIGS. 10, 18A and 18B, typically, the marking platform 120 has a plurality of marking elements 121 attached. As described above for the first embodiment, the marking elements 121 can be graphite lead, ink or any other element that is capable of marking a sheet of paper. Additionally, the marking elements 121 may all have the same shape or, as depicted in FIGS. 10, 18A and 18B, the marking elements 121 may have different shapes, such as but not limited to circular and rectangular as will be described in more detail below. If graphite leads are used, the leads may all have the same hardness or they may have different hardnesses. The marking elements 121 can be changed or replaced as necessary based on varying wear rates or the geometry or shape of the mark to be transferred to the paper.

The top portion of the marking platform 120 includes an elongate portion 122 that has a complementary shape to the keyed portion 118 in the bottom of the circular shaft 108. In the instant embodiment, the elongate portion 122 is a square protrusion that is inserted into keyed portion 118. When joined together, the keyed portion 118 of the circular shaft 108 and the elongate portion 122 of the marking platform 120, allow the circular shaft 108 and the marking platform 120 to rotate as a single structure. As will be readily apparent to those skilled in the art, any key geometry or any other means that causes the circular shaft 108 and the marking platform 120 to rotate as a single structure, may be used.

Additionally, as shown in FIG. 10, disposed between the bottom portion 116 of the circular shaft 108 and the marking platform 120 is a second spring 124, which urges the marking platform 120 and the marking elements 121 toward the paper sheet. The marking instrument further comprises a cap element 126. The cap element 126, as depicted in the figures, includes an opening 128 at its bottom end that allows the marking elements 121 to protrude through in order to contact an answer sheet. As shown in FIGS. 4A, 4B and 4C, answer spaces typically have a circular 25, oval 27 or rectangular 29 shape. Consequently, as depicted in FIGS. 19A, 19B, 20A, 20B, 21A and 21B, the opening 128 in the cap element 126 can have various geometric shapes, such as but not limited to, circular (FIGS. 19A and 19B), oval (FIGS. 20A and 20B) and rectangular (FIGS. 21A and 21B), that correspond to the geometry of the answer spaces on an answer sheet. Therefore, changing the cap element 126 allows a user to take a multitude of tests having answer spaces of different geometric configurations.

As can further be seen in the Figures, the cap element 126 has a tapered bottom portion 134. The tapered bottom portion 134 is not only aesthetically pleasing but it is functional as well. The tapering in the cap element 134 supports the larger bottom portion 116 of the circular shaft 108 and prevents the marking elements 121 from being depressed into an answer sheet when a user depresses the depressor element 104. The tapering 134 in the cap element 126 also holds the marking platform 120 in position as it rotates. In addition, the tapered cap facilitates aiming of the marking instrument as a bulky cap will impede a user's vision.

Lastly, as can be seen in FIGS. 10, 11, 12A and 12B, the marking instrument 99 further comprises a push sleeve 136 that is disposed on the body portion 100.

Assembly of a marking instrument according to the instant embodiment is similar to that of the first embodiment. As with the first embodiment, the assembly steps may be performed in any order that results in a marking device that operates as described below. To assemble the marking instrument, the rotation restricting element 105 is placed onto the depressor element 104 in the manner previously described. The depressor spring 106 is then inserted into the internal cavity 102 of the body portion 100. Next, the depressor element 104 with the rotation restricting element 105 disposed thereon, is inserted into the internal cavity 102 on top of the depressor spring 106. The rotation restricting element 105 is constructed to have a diameter that is greater than the diameter of the internal cavity 102. Therefore, depressor element 104 with the rotation restricting element 105 disposed thereon, fit tightly within the interior cavity 102. The frictional forces between the wall surface of the interior cavity 102 and the rotation restricting element 105, prevent the rotation restricting element 105 from rotating. Therefore, the rotation restricting element 105 also prevents the depressor element 104 from rotating when the circular shaft 110 rotates by way of the rotation restricting element's wings 107 that are engaged with the elongate slots in the depressor element 105. Similar to the first embodiment, rotation of the depressor element 104 can also be prevented by constructing the depressor element 104 and the internal cavity 102 of the body portion 100 to have complementary shapes, such as but not limited to hexagonal, triangular, rectangular, square, oval, etc. In addition to having complementary shapes, the depressor element 104 and the internal cavity 102 can be constructed in any manner that prevents the depressor element 104 from rotating within the internal cavity 102. An example of an additional rotation restriction means may be, as previously described, one that includes one or more longitudinally extending ribs on the exterior wall of the depressor element that engage(s) one or more narrow, elongate, grooves on the interior wall surface of the internal cavity. With this type of construction the cross-sectional shape of the depressor element and the internal cavity 8 may be circular except for the rib(s) and grooves(s).

A push sleeve 136 is installed on top of the body portion 100 in order to keep the depressor element 104 and the depressor spring 106 within the internal cavity 102. As can be seen in FIGS. 12A and 12B, the depressor element 104 extends above the top of the body portion 100. Therefore, the top of the push sleeve 136 contacts the top of the depressor element 104. Next, the circular shaft 108 is inserted into the internal cavity 114 of the depressor element 104 from the bottom end of the cavity 114. The circular shaft 108 is inserted using a rotational motion so that the angled fins or protrusions 112 in the internal cavity 114 of the depressor element 104 engage the external grooves 110 of the circular shaft 108.

After the circular shaft 106 is in place, a spring 124 is disposed on the elongate portion 122 of the marking platform 120. The elongate portion 122 of the marking platform 120 is then inserted into the keyed portion 118 at the bottom end 116 of the circular shaft 108. Lastly, the desired cap element 126 is screwed onto the threads 137 at the bottom end of the body portion 100, thereby completing assembly of the marking instrument.

To operate a marking instrument according to the instant embodiment of the invention, a user positions the assembled instrument having a cap element 126 attached with an opening 128 that corresponds to the geometric shape of the answer spaces on an answer sheet, over the desired answer space. Once the cap element 126 is in contact with the answer sheet, a user depresses the push sleeve 136. Depressing the push sleeve 136 causes the depressor element 104 to be depressed vertically downward. The vertical downward movement the depressor element 104 imparts a rotational motion on the circular shaft 108. That is, the angled fins or protrusions 112 in the depressor's internal cavity 114, travel within the grooved surface 110 of the circular shaft 108, thereby rotating the shaft as the depressor element 104 moves up and down. The rotating circular shaft 108 rotates the marking platform 120 by way of the interlocked or mated keyed portion 118 of the circular shaft 108 and the elongate portion 122 of the marking platform 120. The rotating marking elements 121 on the bottom of the marking platform 120 rotate within the opening 128 at the bottom of the cap element 126. If a rectangular mark is desired, the marking element(s) does not rotate as will be described below. Rotation of the marking elements 121 within opening 128 and the marks produced on an answer sheet as well as the various configurations for the marking platform 120 and the marking elements 121, will be discussed in more detail below. Once the push sleeve 136 and the depressor element 104 are fully depressed, the depressor spring 106 urges both elements vertically upwards to their starting positions. One depression of the push sleeve 136 and the depressor element 104 should completely fill in and darken the answer space, however, a user may repeat this process as many times as necessary to obtain the desired marking.

Figure 22:
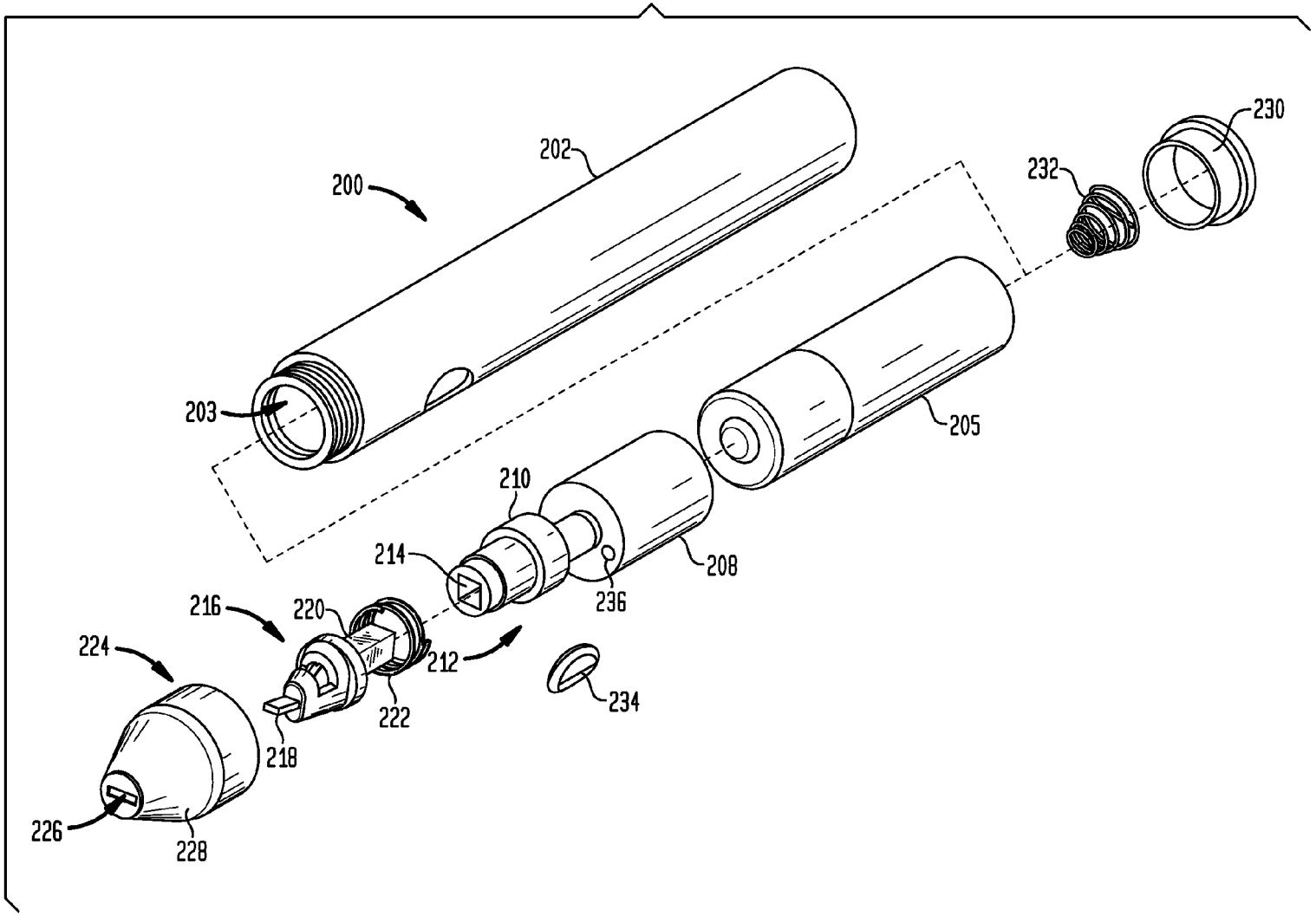
FIG. 22 is an exploded perspective view of a marking instrument, according to one embodiment of the present invention.
Figure 23:
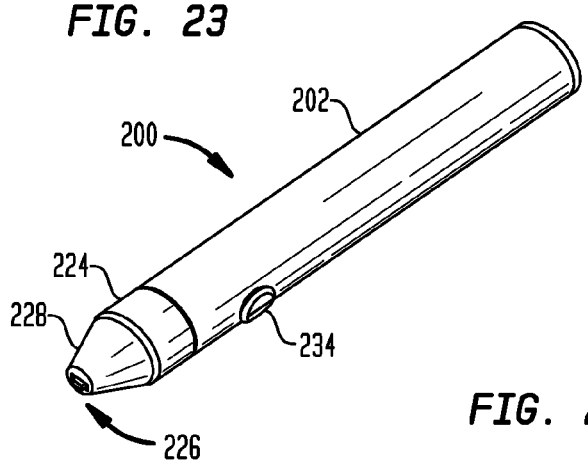
FIG. 23 is a perspective view of a marking instrument, according to one embodiment of the present invention.
Figure 24A:
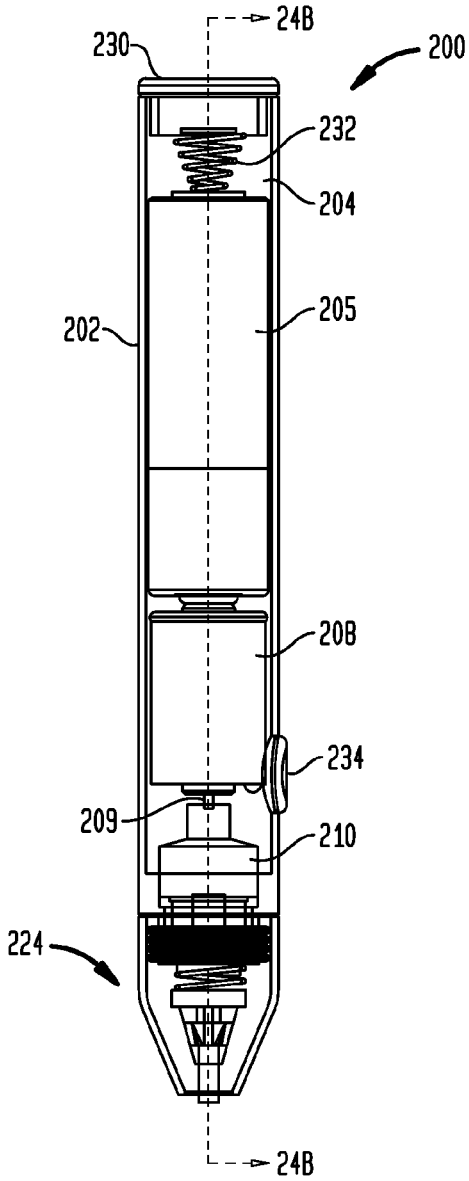
FIG. 24A is a cut away view of a marking instrument, according to one embodiment of the present invention.
Figure 24B:
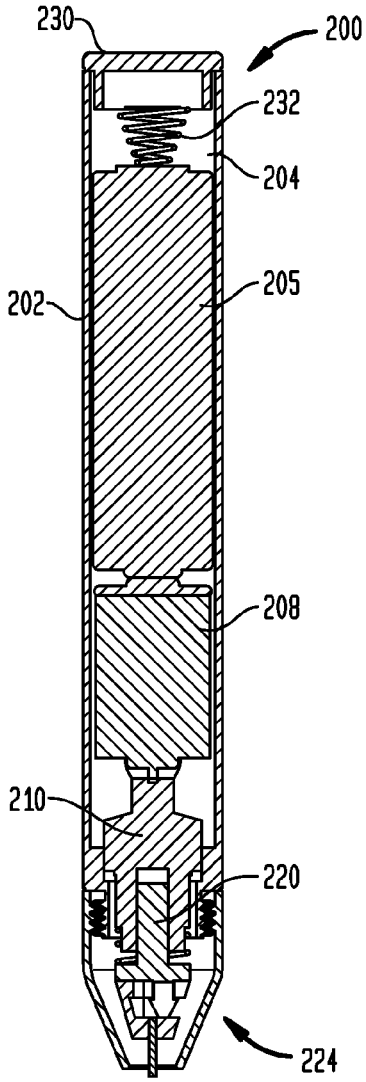
FIG. 24B is a cross-sectional view of the marking instrument depicted in FIG. 24A.
Figure 25A:
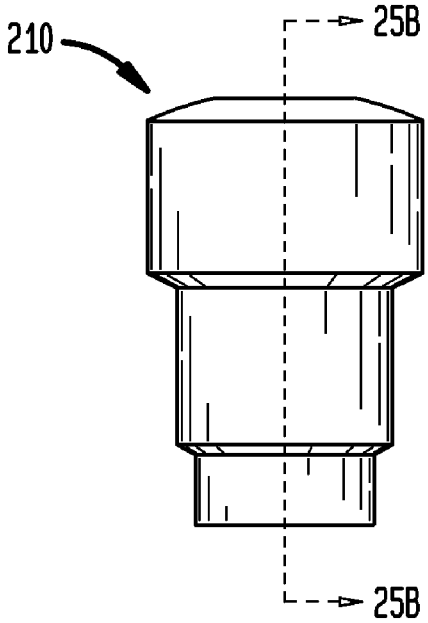
FIG. 25A is a side view of a drum, according to one embodiment of the present invention.
Figure 25B:
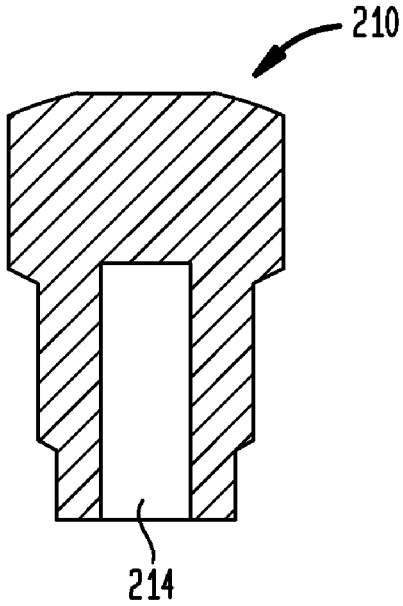
FIG. 25B is a cross-sectional view of the drum depicted in FIG. 25A.

In a third embodiment of the instant invention, instead of a user physically depressing a depressor element to mechanically rotate the marking platform, an electric motor is used to rotate the marking platform. As depicted in FIGS. 22, 23, 24A and 24B, a marking instrument 200 according to this embodiment comprises a circular body portion 202 having an internal cavity 203. FIG. 24B is a cross-sectional view of FIG. 24A, which is an assembled marking instrument according to the instant embodiment. Within the internal cavity 203 is a battery compartment 204 for a battery 205. Disposed beneath the battery compartment 204 towards the bottom end 206 of the body portion 202 is an electric motor 208. Connected to the drive shaft 209 of the electric motor is a circular drum 210. As depicted in FIGS. 22, 25A and 25B, the bottom portion 212 of the drum 210 includes a keyed portion 214. FIG. 25B is a cross-sectional view of the drum 210 depicted in FIG. 25A. As can be seen in the Figures, the keyed portion 214 in the instant embodiment is a square recess.

Figure 26A:
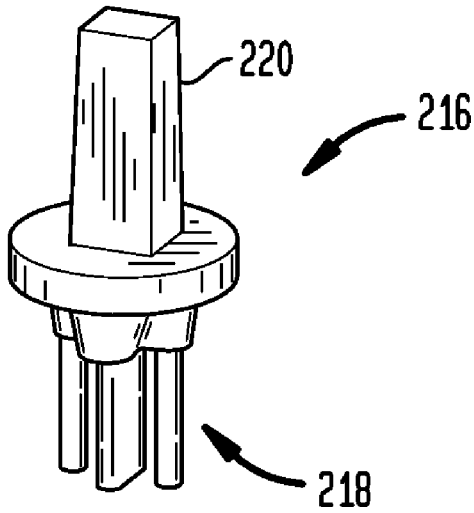
FIG. 26A is a top perspective view of a marking platform, according to one embodiment of the present invention.
Figure 26B:
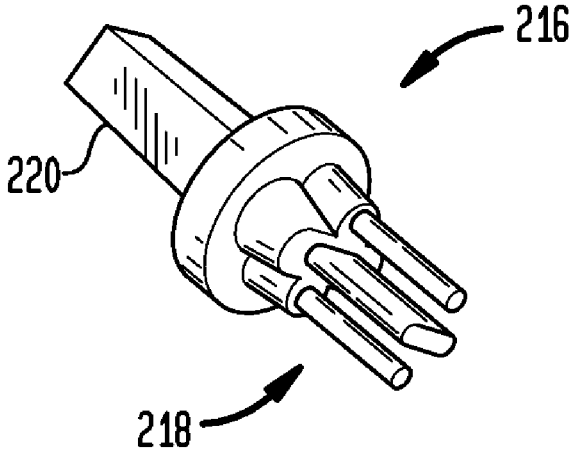
FIG. 26B is a bottom perspective view of the marking platform depicted in FIG. 26A.
Figure 27A:
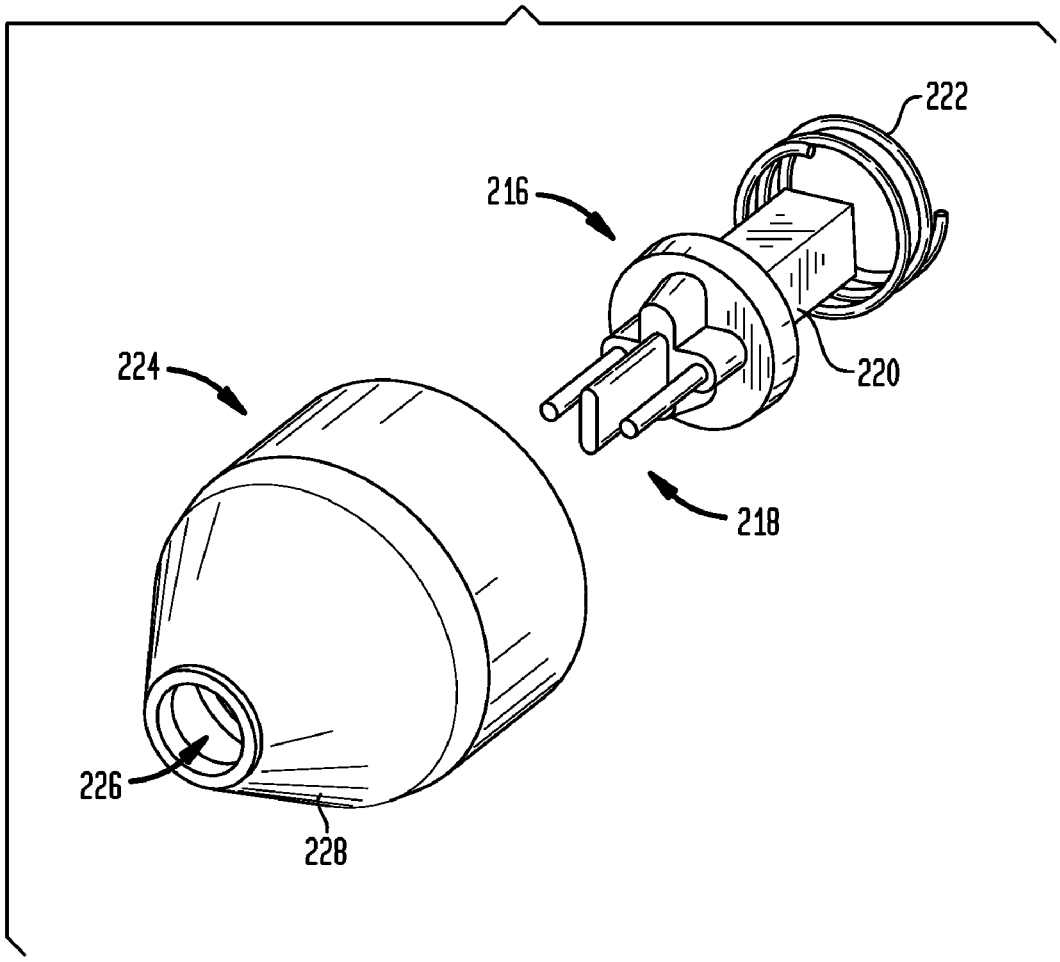
FIG. 27A is an exploded perspective view of a cap element with a marking platform, according to one embodiment of the present invention.
Figure 27B:
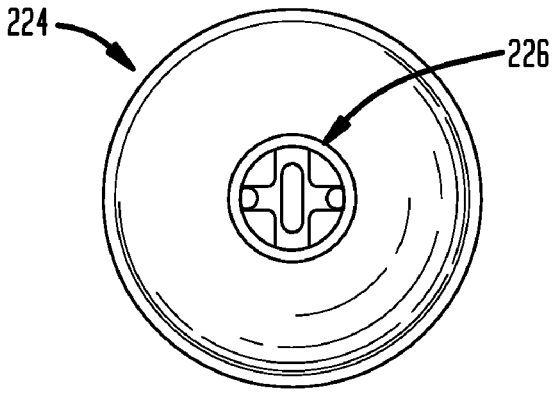
FIG. 27B is a bottom plan view of the cap element and marking platform depicted in FIG. 27A.
Figure 28A:
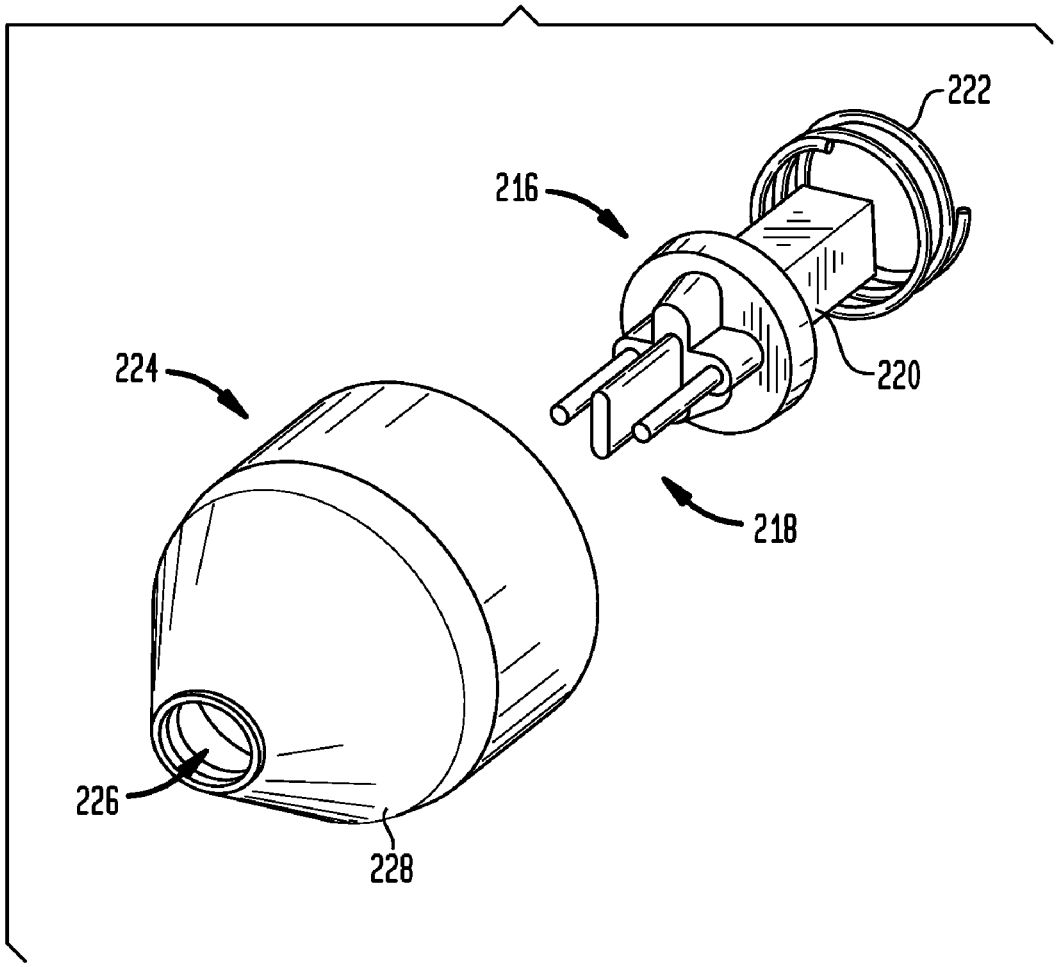
FIG. 28A is an exploded perspective view of a cap element with a marking platform, according to one embodiment of the present invention.
Figure 28B:
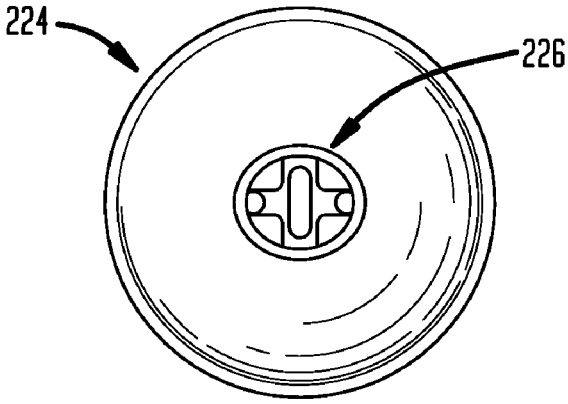
FIG. 28B is a bottom plan view of the cap element and marking platform depicted in FIG. 28A.
Figure 29A:
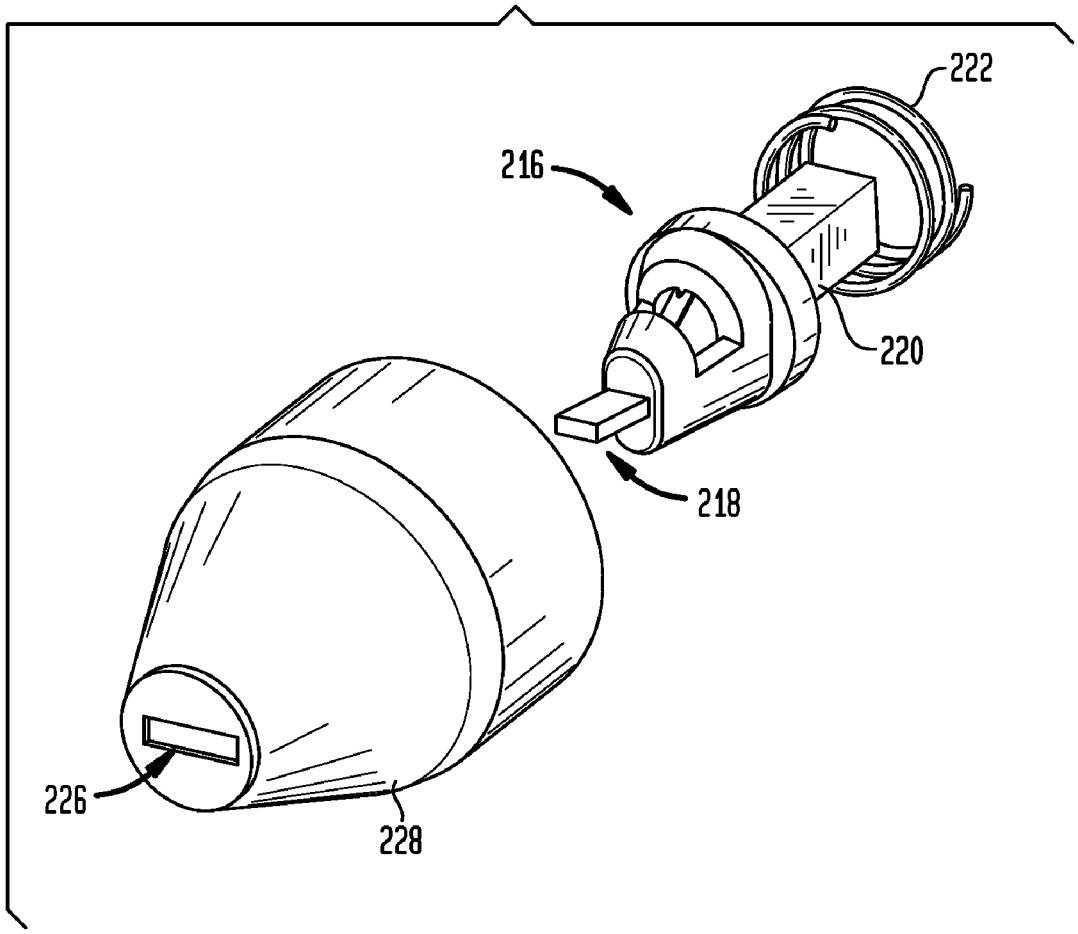
FIG. 29A is an exploded perspective view of a cap element with a marking platform, according to one embodiment of the present invention.
Figure 29B:
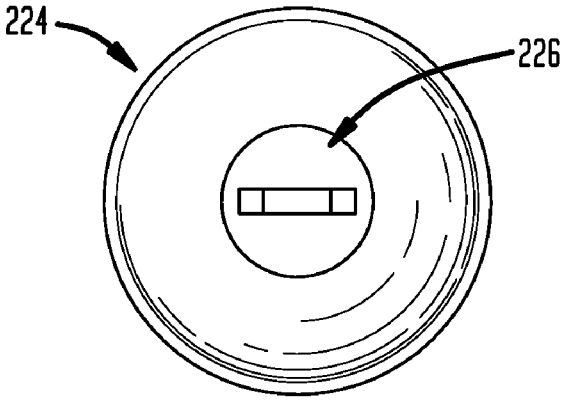
FIG. 29B is a bottom plan view of the cap element and marking platform depicted in FIG. 29A.

As depicted in FIGS. 22, 23, 24A and 24B, the marking instrument 200 further comprises a marking platform 216 onto which at least one marking element 218 is attached. As can be seen in FIGS. 22, 26A and 26B, typically, the marking platform 216 has a plurality of marking elements 218 attached. As described above for the first and second embodiments, the marking elements can be graphite lead, ink or any other element that is capable of marking a sheet of paper. Additionally, the marking elements may all have the same shape or, as depicted in the Figures, the marking elements 218 may have different shapes as will be described in more detail below. If graphite leads are used, the leads may all have the same hardness or they may have different hardnesses. The marking elements 218 can be changed as necessary based on varying wear rates or the geometry or shape of the mark to be transferred to the paper.

The top portion of the marking platform 216 includes an elongate portion 220 that has a complementary shape to the keyed portion 214 in the bottom of the drum 210. In the instant embodiment the elongate portion 220 is a square protrusion that is inserted into keyed portion 214. When joined together, the keyed portion 214 in the bottom of the drum 210 and the elongate portion 220 of the marking platform 216, allow the drum 210 and the marking platform 216 to rotate as a single structure. As will be readily apparent to those skilled in the art, any key geometry or any other means that causes the drum and the marking platform 216 to rotate as a single structure, may be used.

Additionally, disposed between the bottom portion of the drum 210 and the marking platform 216 is a spring 222, which urges the marking platform 216 and the marking elements 218 toward the paper sheet. The marking instrument further comprises a cap element 224. As can be seen in the Figures, specifically FIGS. 27A, 27B, 28A, 28B, 29A and 29B, the cap element 224 includes an opening 226 at its bottom end to allow the marking elements 218 to protrude through in order to contact an answer sheet. As shown in FIGS. 4A, 4B and 4C, answer spaces typically have a circular 25, oval 27 or rectangular 29 shape. Consequently, as depicted in FIGS. 27A, 27B, 28A, 28B, 29A and 29B, the opening 226 in the cap element 224 can have various geometric shapes, such as but not limited to, circular (FIGS. 27A and 27B) oval (FIGS. 28A and 28B) and rectangular (FIGS. 29A and 29B), that correspond to the geometry of the answer spaces on an answer sheet. Therefore, changing the cap element 224 allows a person to take a multitude of tests having answer spaces of different geometric configurations.

As can further be seen in the Figures, the cap element 224 has a tapered bottom portion 228. The tapered bottom portion 228 is not only aesthetically pleasing but it is functional as well. The tapering in the cap element 224 holds the marking platform 216 in place as it rotates. The marking instrument 200 also includes a top cap portion 230 that includes a contact 232 to complete the circuit for the battery operated motor 208, and a switch 234 in the form of a push button to activate the motor 208. It will be readily apparent to those skilled in the art that alternative activation means may be used to activate the motor 208. For example, the marking instrument can be constructed with a pressure activating means, such as a pressure switch, that actuates the motor when a downward pressure is applied to the marking elements 226.

As depicted in FIG. 22, to help a user correctly position the marking instrument 200 above the desired answer space, the marking instrument 200 may also include a light emitting diode ("LED") or an optical waveguide 236. The LED and optical waveguide projects the shape of the opening 226 in the cap element 224 onto the answer sheet, which allows a user to easily position the marking instrument over the desired answer space. An LED or optical wave guide may also be included on the marking instruments associated with the first and second embodiments disclosed above.

To operate a marking instrument according to the instant embodiment of the invention, a user positions the assembled instrument having a cap element 224 attached with an opening 226 that corresponds to the geometric shape of the answer spaces on an answer sheet, over the desired answer space. Once the cap element 224 is in contact with the answer sheet, a user simply depresses the button switch 234 to activate the motor 208. Once activated, the motor 208 rotates the drum 210 which in turn, by way of the interlocked or mated keyed portion 214 and elongate portion 220, also rotates the marking platform 216. The rotating marking elements 218 on the bottom of the marking platform 216 rotate within the opening 226 at the bottom of the cap element 224. If a rectangular mark is desired, the marking element(s) does not rotate as will be described below. Rotation of the marking elements 218 within opening 226 and the marks produced on an answer sheet as well as the various configurations for the marking platform 216 and the marking elements 218, will be discussed in more detail below. After a user is satisfied with the mark produced on an answer sheet, the user removes pressure from the button switch 234, thereby opening the circuit and deactivating the motor 206.

As previously disclosed, the marking platform and the cap element may have numerous configurations to obtain the desired mark on an answer sheet. For example, the marking elements can be graphite lead, ink or any other material that will mark a sheet of paper. The marking elements can be a single element or a plurality of elements. If a plurality of marking elements are used, all of the elements may have the same shape or be of the same material (i.e. graphite) or they may be a combination of materials and geometric shapes. Typical geometric shapes for the marking elements include, and are not limited to circular, oval, rectangular and square.

Figure 30A:
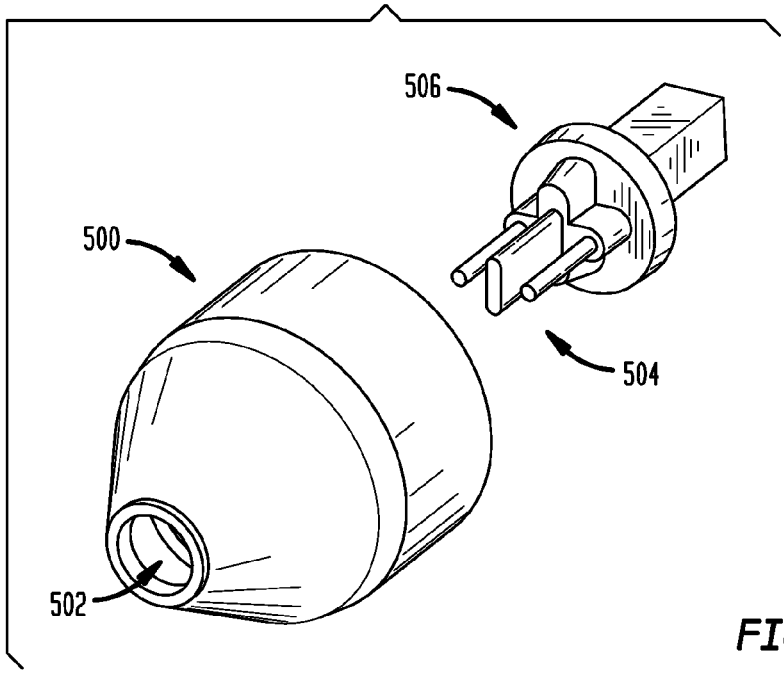
FIG. 30A is an exploded perspective view of a cap element with a marking platform, according to one embodiment of the present invention.
Figure 30B:
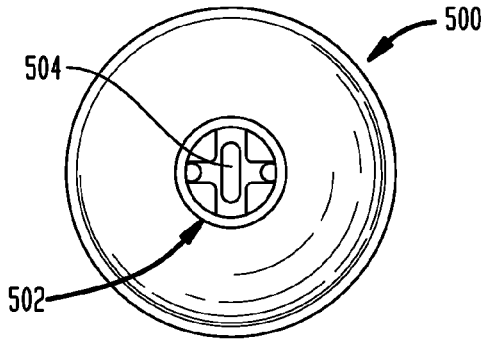
FIG. 30B a bottom plan view of the cap element and marking platform, according to one embodiment of the present invention.
Figure 30C:
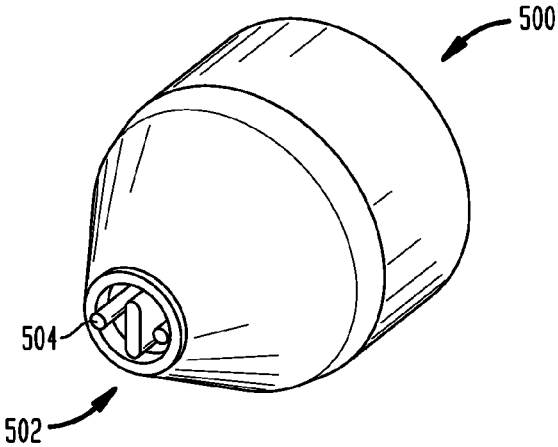
FIG. 30C is a perspective view of a cap element with a marking platform inserted therein, according to one embodiment of the present invention.
Figure 30D:
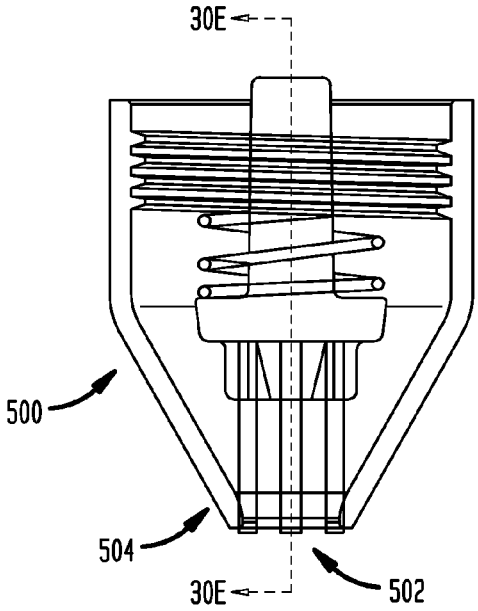
FIG. 30D is a cut away view of a cap element with a marking platform inserted therein, according to one embodiment of the present invention.
Figure 30E:
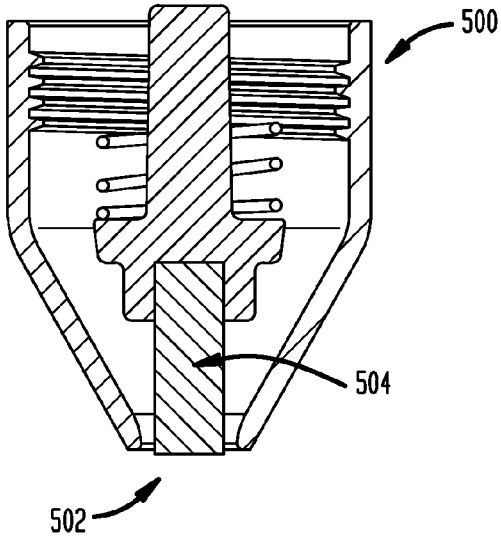
FIG. 30E is a cross-sectional view of the cap element with a marking platform inserted therein depicted in FIG. 30D.
Figure 30F:
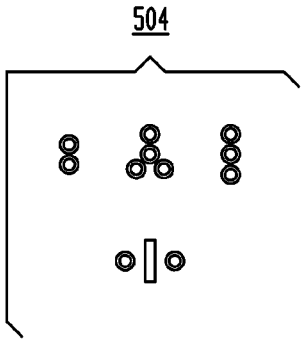
FIG. 30F depicts sample marking element configurations for making a circular mark.

To make or draw a circular mark on a piece of paper, as depicted in FIGS. 30A-30E, the cap element 500 will have a circular opening 502. FIG. 30E is a cross-sectional view of FIG. 30D. When making a circular mark, the marking elements 504, for example, can be two, three or four circular elements or can be a combination of two circular elements and one rectangular element as shown in FIG. 30F. As can be seen in FIGS. 30C, 30D and 30F, with any of the marking configurations for a circular mark, the marking elements will all protrude through the circular opening 502 in the cap element and will produce a circular mark as the marking platform 506 rotates and the marking elements 504 follow the circular geometry of the circular opening 502.

Figure 31:
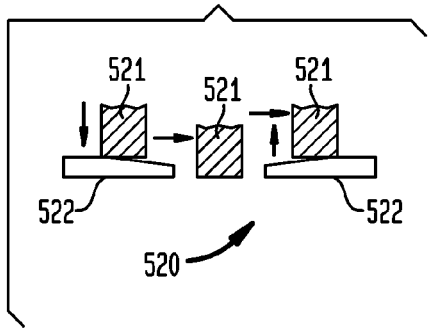
FIG. 31 shows marking element action when a cap element, according to one embodiment of the present invention, is used.

As previously disclosed, in some embodiments, the marking elements will be rotating between the opening in the bottom of the cap element as well as riding on portions of the cap element. Therefore, in these embodiments, the marking platform will have to be a multipiece construction to allow the marking elements to move from side to side and up and down as indicated in FIG. 31 as the marking elements 521 rotate between the opening 520 and the edges 522 of the cap element.

Figure 32A:
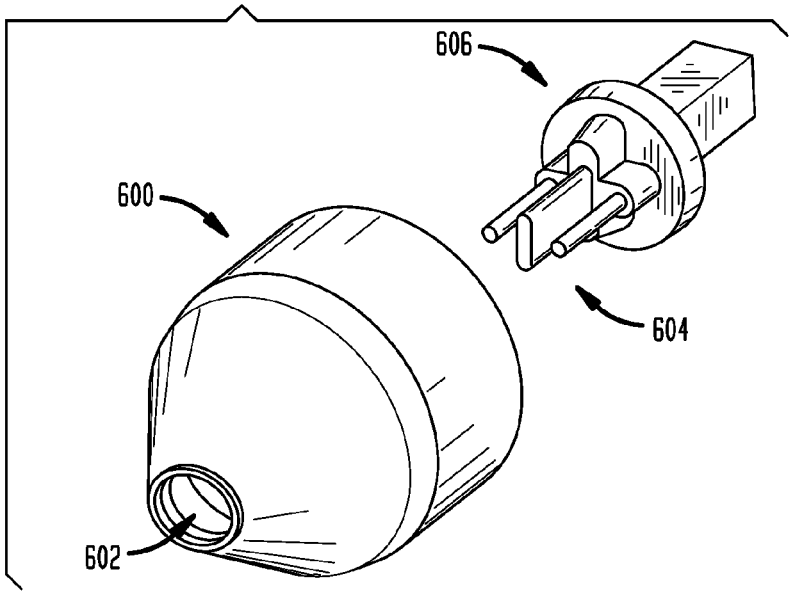
FIG. 32A is an exploded perspective view of a cap element with a marking platform, according to one embodiment of the present invention.
Figure 32B:
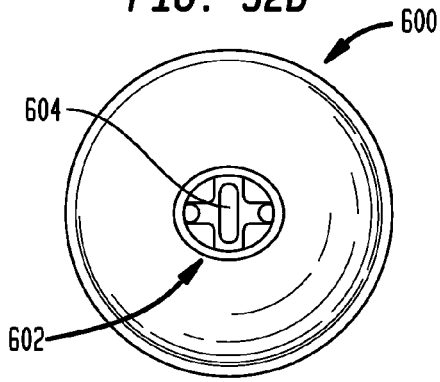
FIG. 32B a bottom plan view of the cap element and marking platform, according to one embodiment of the present invention.
Figure 32C:
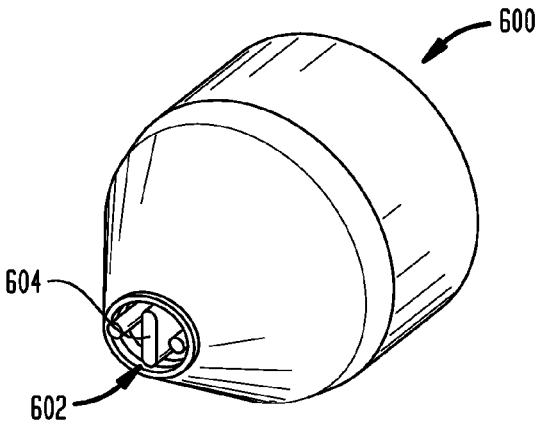
FIG. 32C is a perspective view of a cap element with a marking platform inserted therein, according to one embodiment of the present invention.
Figure 32D:
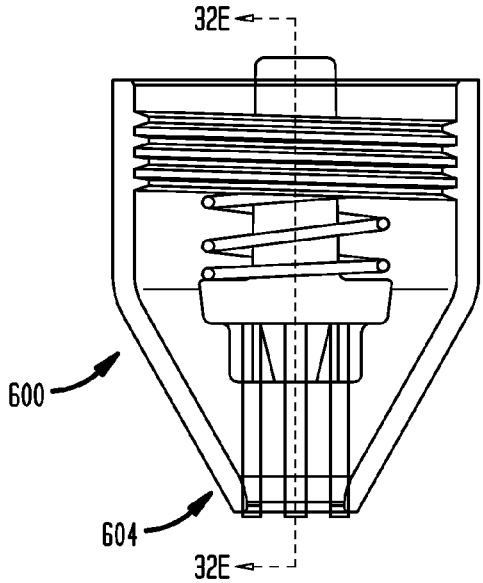
FIG. 32D is a cut away view of a cap element with a marking platform inserted therein, according to one embodiment of the present invention.
Figure 32E:
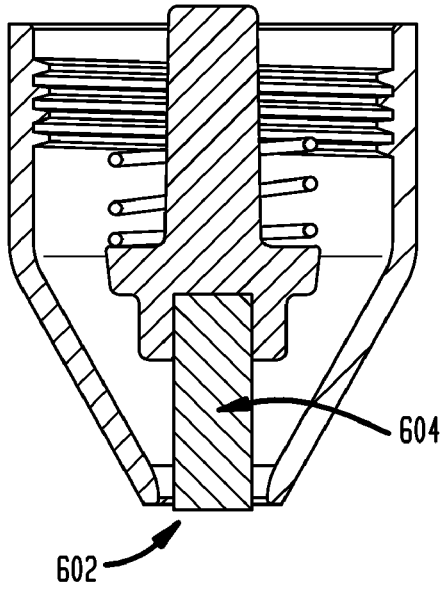
FIG. 32E is a cross-sectional view of the cap element with a marking platform inserted therein depicted in FIG. 32D.
Figure 32F:
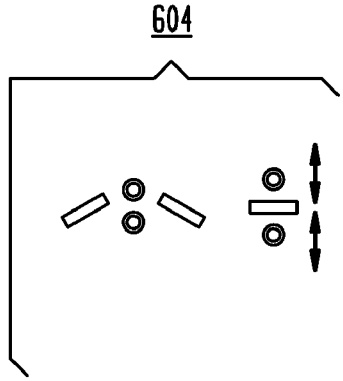
FIG. 32F depicts sample marking element configurations for making an oval mark.
Figure 33A:
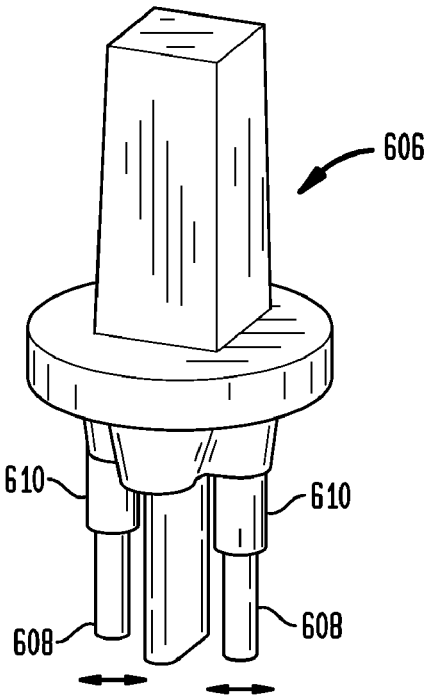
FIG. 33A is a top perspective view of a marking platform, according to one embodiment of the present invention.
Figure 33B:
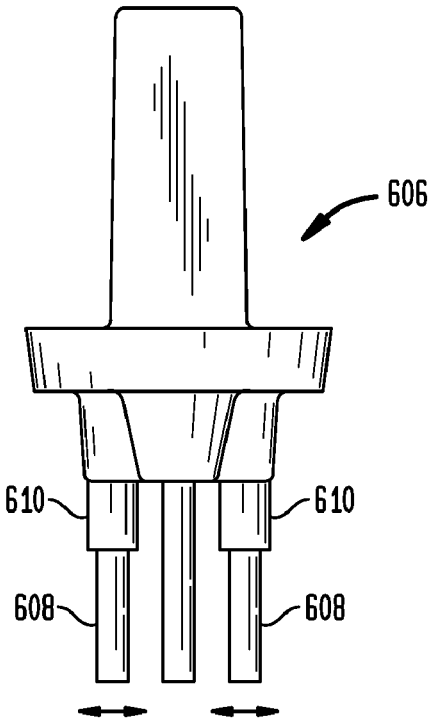
FIG. 33B is a side view of the marking platform depicted in FIG. 33B.

To make or draw an oval mark on a piece of paper, as depicted in FIGS. 32A-32E, the cap element 600 will have an oval opening 602. FIG. 32E is a cross-sectional view of FIG. 32D. When making an oval mark, the marking elements 604, for example, can be two circular elements and two rectangular elements or two circular elements and one rectangular element as depicted in FIG. 32F. If using a cap element that has portions that the marking elements ride on as previously described, then a multipiece marking platform described above with respect to FIG. 31 will be necessary. However, when a cap element 600 depicted in FIGS. 32A-32E that allows all of the marking elements 604 to protrude through the opening 602 in the bottom of the marking instrument at all times, a marking platform similar to that shown in FIGS. 33A and 33B may be used. As shown in the Figures, the outer marking elements 608 attach to portions 610 of the marking platform 606 that are flexible and therefore can move back and forth as indicated by the double-headed arrows in the Figures, as the marking platform 606 rotates. That is, because the marking elements 604 protrude through the opening 602 in the cap element 600 as shown in FIGS. 32C, 32D and 32E, the outer circular marking elements will need to follow the oval geometry of the opening. By attaching the outer circular marking elements to portions of the marking platform 606 that are flexible and can therefore move independently from the movement of the marking platform 606, the outer marking elements 608 can move back and forth thereby following the oval geometry of the opening 602 as the marking platform 606 rotates in order to draw or produce an oval mark on a sheet of paper.

Figure 34A:
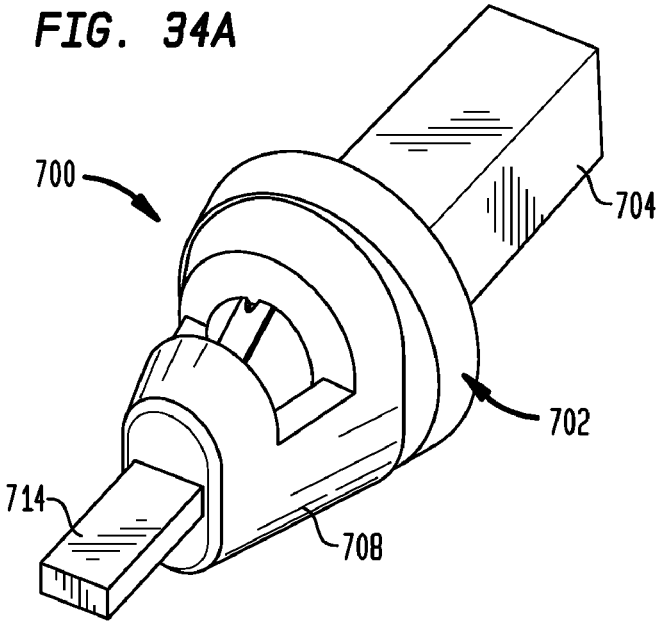
FIG. 34A is a bottom perspective view of a marking platform, according to one embodiment of the present invention.
Figure 34B:
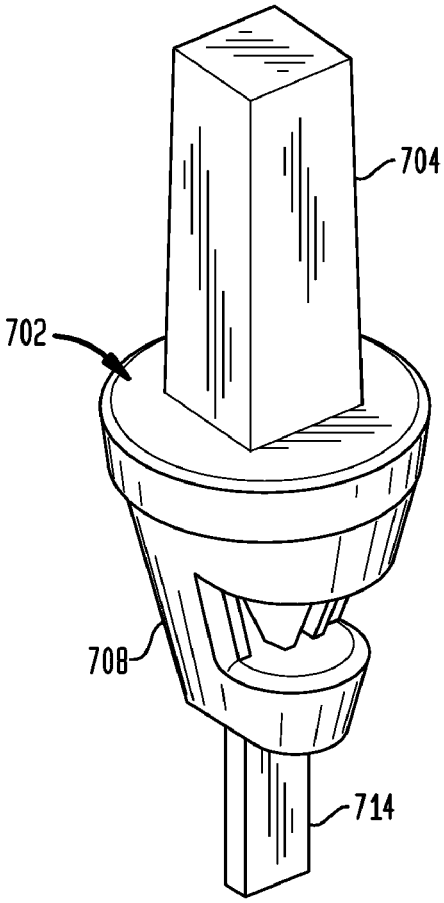
FIG. 34B is a top perspective view of the marking platform depicted in FIG. 34A.
Figure 34C:
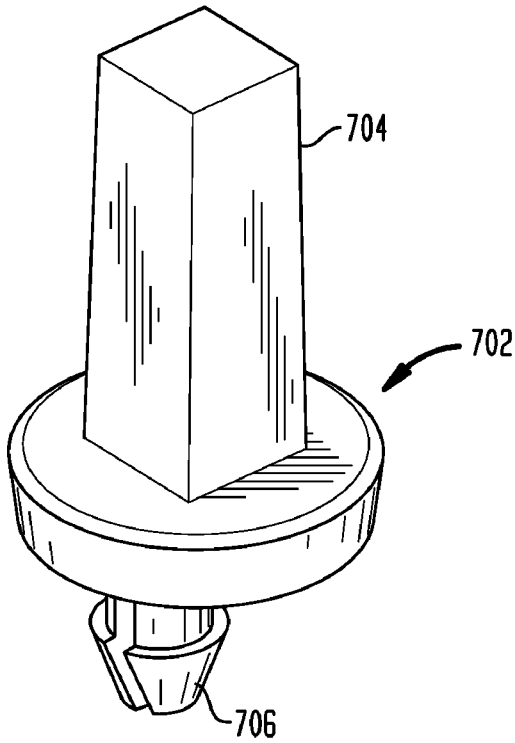
FIG. 34C is a top perspective view of a drum portion of a marking platform, according to one embodiment of the present invention.
Figure 34D:
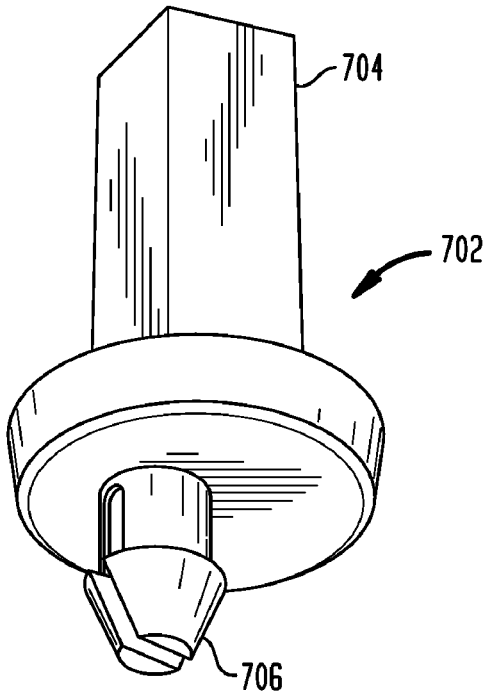
FIG. 34D is a bottom perspective view of the drum portion of a marking platform depicted in FIG. 34C.
Figure 34E:
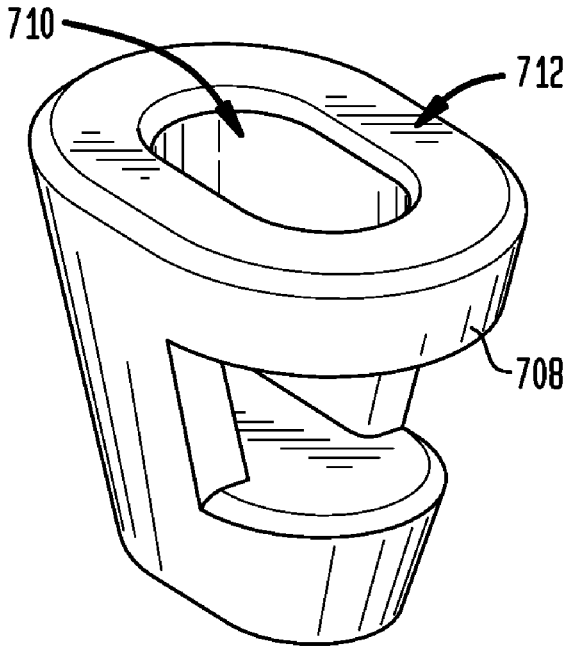
FIG. 34E is a top perspective view of a slide couple of a marking platform, according to one embodiment of the present invention.
Figure 34F:
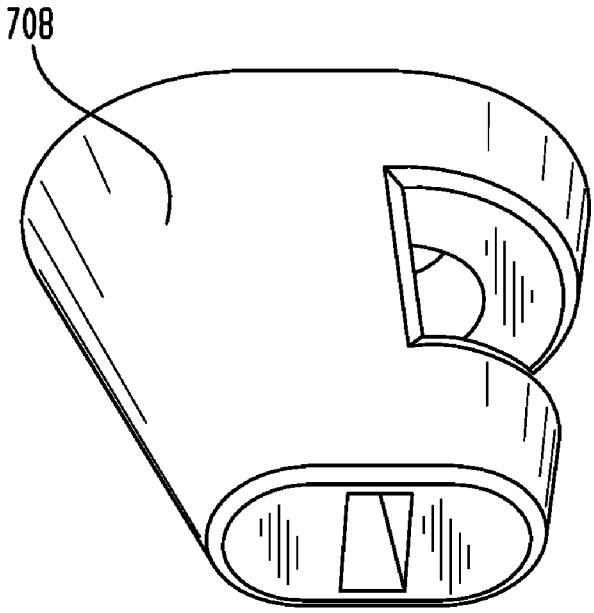
FIG. 34F is a bottom perspective view of the slide couple of a marking platform depicted in FIG. 34E.

Lastly, to make or draw a rectangular mark on a piece of paper, a two-piece marking platform 700 depicted in FIGS. 34A-34F will be used. As shown in the Figures, the two-piece marking platform 700 comprises a drum portion 702 that includes an elongate portion 704 that has a complementary shape to the keyed portion in the bottom of the circular shaft or in the bottom of the drum in the motorized embodiment, and a peg or protrusion 706 attached to the bottom of the drum portion 702. As depicted in FIG. 34D, the peg or protrusion 706 is offset from the center of the drum portion 702 such that when the drum portion 702 rotates, the peg or protrusion 706 follows a circular path.

Figure 34G:
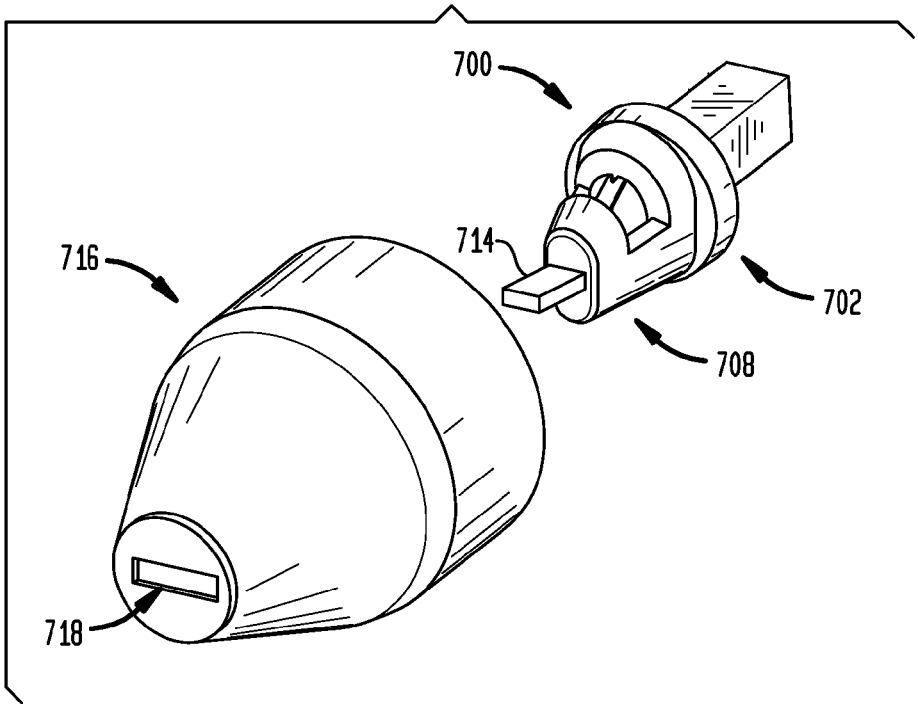
FIG. 34G is an exploded perspective view of a cap element with a marking platform, according to one embodiment of the present invention.

The two-piece marking platform 700 also comprises a slide couple 708. The slide couple 708 has a tapered shape and includes an oblong opening 710 in its upper surface 712 to receive the peg or protrusion 706 from the drum portion 702. As can be seen in FIGS. 34C and 34D, the peg or protrusion 706 is constructed so that it can snap into, and thereby be locked within the oblong opening 710 in the slide couple 108. Lastly, the two-piece marking platform uses a rectangular marking element 714 that is attached to the bottom end of the slide couple 708. As can be seen in FIG. 34G, in order to produce a rectangular mark, a conically-shaped cap element 716 having a rectangular opening 718 in its bottom end is used.

Figure 34H:
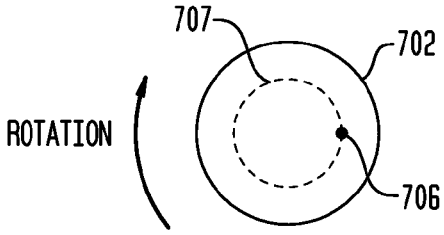
FIG. 34H is a bottom plan view of a drum portion, according to one embodiment of the present invention.
Figure 34I:
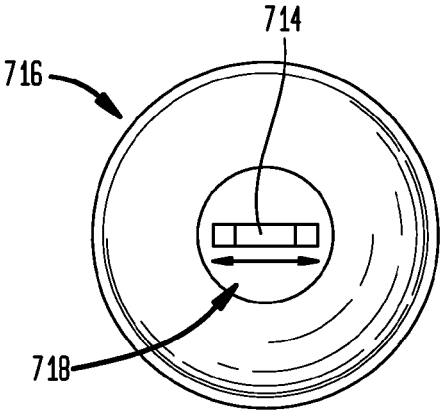
FIG. 34I a bottom plan view of the cap element and marking platform, according to one embodiment of the present invention.
Figure 34J:
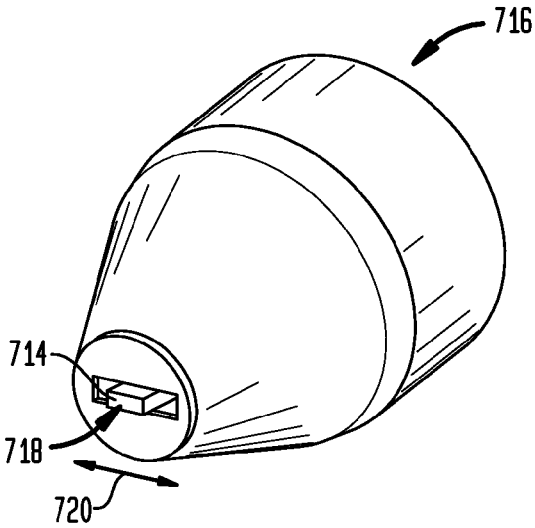
FIG. 34J is a perspective view of a cap element and marking platform inserted therein, according to one embodiment of the present invention.

A rectangular mark is produced as follows. Upon rotation of the circular shaft either by mechanical means by way of a depressor element or by activation of an electric motor, only the drum portion 702 rotates. That is, the slide couple 708 is prevented from rotating because the rectangular marking element 714 that is attached to the bottom of the slide couple 708 is restrained from rotating by the rectangular opening 718 in the bottom of the cap element 716 through which it protrudes. As the drum portion 702 rotates, as shown in FIG. 34H, the peg or protrusion 706 rotates in a circular motion 707. As previously stated, the peg or protrusion 706 is inserted into the oblong opening 710 in the slide couple 708 and locked in place. Therefore, as the peg or protrusion 706 rotates on the drum portion 702, the slide couple 708 converts the circular motion of the peg or protrusion 706 into a lateral side to side motion. This side to side motion of the slide couple 708 results in the rectangular marking element 714 moving in a side to side motion within the rectangular opening 718 in the bottom of the cap element 716 as indicated by the double headed arrow 720 in FIGS. 34I and 34J. The side to side motion of the marking element 714 is guided by and restrained by the rectangular opening 718 in the bottom of the cap element 716. Therefore, as the drum portion 702 rotates, the lateral side to side motion of the marking element 714 produces a rectangular mark on a sheet of paper.

In all embodiments of the instant invention, plastic materials may be used to construct the various elements that comprise the instant invention. Additional materials that may be used to construct the instant invention will be readily apparent to those skilled in the art.

In addition to being used to mark answers on a multiple choice or "True" and "False" answer sheet, the instant invention may be used to mark lottery tickets, ballots, data sheets, surveys or the like.

Having thus described in detail preferred embodiments of the present invention, it is to be understood that the invention defined by the above paragraphs is not to be limited to particular details set forth in the above description, as many apparent variations thereof are possible without departing from the spirit or scope of the present invention.

What is claimed is:

1. A marking instrument configured for use in filling an answer blank on an answer sheet, the marking instrument comprising:

an upper body portion having an internal cavity disposed therein;

a depressor element disposed at least partially within the upper body portion;

a depressor spring that is mechanically coupled to the depressor element to provide an elastic force thereto at least while the depressor element is displaced linearly;

a spirally-grooved circular shaft that is configured to cooperate with the depressor element such that the spirally grooved circular shaft rotates about its longitudinal axis in response to the depressor element being displaced linearly;

a marking platform having at least one marking element disposed thereon, and being configured such that at least a portion of the marking platform rotates in response to rotation of the spirally grooved circular shaft;

a cap element having an opening that corresponds to a geometric shape of the answer blank; and wherein the cap element and the marking platform are configured such that, during at least a portion of the rotation of at least a portion of the marking platform, at least one of the marking elements protrudes though said opening and moves relative to the cap as the cap guides the motion of at least one of the protruding marking elements in accordance with the shape of opening.

2. The marking instrument of claim 1 further comprising a lower body portion having an internal cavity disposed therein.

3. The marking instrument of claim 1 further comprising a rotation prevention means for preventing the depressor element from rotating within the internal cavity of the upper body portion.

4. The marking instrument of claim 3, wherein said rotation prevention means comprises the depressor element having a cross-sectional shape selected from the group consisting of hexagonal, rectangular, square, triangular, circular and oval, that is complementary to a cross-sectional shape of the upper body portion's internal cavity.

5. The marking instrument of claim 3, wherein said rotation prevention means is a rotation restricting element.

6. The marking instrument of claim 1, wherein said internal cavity of said upper body portion includes at least one groove.

7. The marking instrument of claim 6, wherein said depressor element includes at least one rib.

8. The marking instrument of claim 7, wherein said at least one groove and said at least one rib engage one another when said depressor element is inserted into said internal cavity of said upper body portion.

9. The marking instrument of claim 1, wherein the depressor element includes an internal cavity having a circular cross-section.

10. The marking instrument of claim 9, wherein said internal cavity in said depressor element includes a plurality of angled fins or protrusions to receive the spirally-grooved circular shaft.

11. The marking element of claim 1, wherein said depressor element comprises a plurality of elongate slots.

12. The marking instrument of claim 1, wherein said marking platform comprises a plurality of marking elements.

13. The marking instrument of claim 12, wherein said plurality of marking elements are graphite.

14. The marking instrument of claim 13, wherein said plurality of graphite marking elements all have the same or different hardness.

15. The marking instrument of claim 12, wherein said plurality of marking elements are ink.

16. The marking instrument of claim 12, wherein said plurality of marking elements have a cross-sectional shape selected from the group consisting of circular, oval, square and rectangular.

17. The marking instrument of claim 12, wherein said marking platform is a multipiece construction.

18. The marking instrument of claim 17, wherein said plurality of marking elements are capable of independent movement.

19. The marking instrument of claim 1, wherein said marking platform includes a plurality of flexible portions.

20. The marking instrument of claim 1, wherein said at least one marking element is graphite.

21. The marking instrument of claim 1, wherein said at least one marking element in ink.

22. The marking instrument of claim 1, wherein said cap element includes an opening with a geometric shape selected from the group consisting of circular, oval and rectangular.

23. The marking instrument of claim 1, further comprising an optical wave guide and/or LED.

24. The marking instrument of claim 1, wherein said spirally-grooved circular shaft includes a keyed portion.

25. The marking instrument of claim 24, wherein said marking platform includes an elongate portion having a shape that is complementary to the keyed portion of the spirally-grooved circular shaft.

26. The marking instrument of claim 1, wherein said marking platform comprises a drum portion, a slide couple and a rectangular marking element.

27. The marking instrument of claim 26, wherein said marking instrument includes a cap element having a rectangular opening.

28. The marking instrument of claim 27, wherein said marking platform comprising said drum portion, said slide couple, said rectangular marking element and said cap element having a rectangular opening convert a rotational motion to a lateral side to side motion.

29. The marking instrument of claim 1 further comprising a push cap.

30. The marking instrument of claim 1 further comprising a push sleeve.

31. A marking instrument configured for use in filling an answer space on an answer sheet or making a desired mark, the marking instrument comprising:

a body portion having an internal cavity disposed therein;

a rotation means disposed within the interior cavity of the body portion;

a marking platform having at least one marking element disposed thereon, and being configured such that at least a portion of the marking platform rotates in response to rotation of the rotation means; and a cap element having an opening that corresponds to the geometric shape of the desired mark or the geometric shape of the answer space; and wherein the cap element and the marking platform are configured such that, during at least a portion of the rotation of at least a portion of the marking platform, at least one of the marking elements protrudes though said opening and moves relative to the cap as the cap guides the motion of at least one of the protruding marking elements in accordance with the shape of opening.

32. The marking instrument of claim 31, wherein said rotation means is an electric motor.

33. The marking instrument of claim 31 further comprising a motor actuation means.

34. The marking instrument of claim 31, wherein said motor actuation means is a switch.

35. The marking instrument of claim 31 further comprising a battery.

36. The marking instrument of claim 31 further comprising a depressor element.

37. The marking instrument of claim 36, wherein the depressor element includes an internal cavity having a circular cross-section.

38. The marking instrument of claim 37 further comprising a spirally-grooved circular shaft.

39. The marking instrument of claim 38, wherein said spirally-grooved circular shaft includes a keyed portion.

40. The marking instrument of claim 39, wherein said marking platform includes an elongate portion having a shape that is complementary to the keyed portion of the spirally-grooved circular shaft.

41. The marking instrument of claim 38, wherein said internal cavity in said depressor element includes a plurality of angled fins or protrusions to receive the spirally-grooved circular shaft.

42. The marking element of claim 36, wherein said depressor element comprises a plurality of elongate slots.

43. The marking instrument of claim 31 further comprising a rotation prevention means.

44. The marking instrument of claim 43, wherein said depressor rotation prevention means is a rotation restricting element.

45. The marking instrument of claim 31, wherein said marking platform comprises a plurality of marking elements.

46. The marking instrument of claim 45, wherein said plurality of marking elements are graphite.

47. The marking instrument of claim 45, wherein said plurality of marking elements are ink.

48. The marking instrument of claim 31, wherein said marking platform includes a plurality of flexible portions.

49. The marking instrument of claim 31, wherein said at least one marking element is graphite.

50. The marking instrument of claim 31, wherein said at least one marking element in ink.

51. The marking instrument of claim 31, wherein said cap element includes an opening with a geometric shape selected from the group consisting of circular, oval and rectangular.

52. The marking instrument of claim 31, further comprising an optical wave guide and/or LED.

53. The marking instrument of claim 31, wherein said marking platform comprises a drum portion, a slide couple and a rectangular marking element.

54. The marking instrument of claim 53, wherein said marking instrument includes a cap element having a rectangular opening.

55. The marking instrument of claim 54, wherein said marking platform comprising said drum portion, said slide couple, said rectangular marking element and said cap element having a rectangular opening convert a rotational motion to a lateral side to side motion.

56. The marking instrument of claim 31 further comprising a push sleeve.

57. The marking instrument of claim 31 further comprising a depressor spring.

58. The marking instrument of claim 1, wherein the shape of the opening is non-circular.

59. The marking instrument of claim 58, wherein the shape of the opening is oval.

60. The marking instrument of claim 58, wherein the shape of the opening is rectangular.

61. The marking instrument of claim 1, wherein the shape of the opening is circular.

62. The marking instrument of claim 1, wherein the cap is removably attachable to provide for removably attaching any one of a plurality of different caps having differently shaped openings.

* * * * *